US005256026A

United States Patent [19]

Kishi

[11] Patent Number: 5,256,026

[45] Date of Patent: Oct. 26, 1993

[54] ACCESSORY DETACHABLE MECHANISM OF CONSTRUCTION MACHINE

[75] Inventor: Mitsuhiro Kishi, Tochigi, Japan

[73] Assignee: Japanic Corporation, Tochigi, Japan

[21] Appl. No.: 863,404

[22] Filed: Apr. 3, 1992

[30] Foreign Application Priority Data

Apr. 9, 1991 [JP] Japan ..... 3-103295
Apr. 24, 1991 [JP] Japan ..... 3-119134
Apr. 26, 1991 [JP] Japan ..... 3-123083

[51] Int. Cl.[5] ..... F02F 3/32

[52] U.S. Cl. ..... 414/723; 403/321; 403/353

[58] Field of Search ..... 414/723; 37/117.5, 118 R; 403/321, 322, 353; 172/748, 753

[56] References Cited

U.S. PATENT DOCUMENTS 4,643,631 2/1987 Maurer et al. .
4,663,866 5/1987 Karlsson et al. .
4,813,163 3/1989 Livingston et al. .
4,986,722 1/1991 Kaczmarczyk ..... 414/723
5,024,010 6/1991 Huldén .
5,110,254 5/1992 Aubrey .

*Primary Examiner*—Michael S. Huppert
*Assistant Examiner*—Donald W. Underwood
*Attorney, Agent, or Firm*—Flynn, Thiel, Boutell & Tanis

[57] ABSTRACT

A construction machine typically comprises a mobile chassis having an arm vertically swingably mounted thereon, and a working accessory is detachably retained by the tip end of the arm. The arm has a link arrangement with pin holes at upper and lower portions thereof, and retaining grooves at upper ends thereof. The accessory has pin holes at front and rear portions thereof. Retaining elements such as rings or pin are fixed to the accessory. The retaining rings or pin are fitted in the retaining grooves to position the accessory so connecting pins can be inserted into the pin holes to connect the accessory to the arm.

9 Claims, 35 Drawing Sheets

ACCESSORY DETACHABLE MECHANISM OF CONSTRUCTION MACHINE

BACKGROUND OF THE INVENTION

This application is a related application to U.S. Ser. No. 07/735 385, filed Jul. 24, 1991, now abandoned.

1. Field of the Invention

The present invention relates to a construction machine for use in digging and leveling the ground, particularly to an accessory detachable mechanism for detachably attaching an accessory to an arm of a construction machine.

2. Related Art

In construction machines for moving or digging in the ground, such as excavators, back hoes or the like, a conventional mechanism attached to an arm of the construction machine may be replaced by an accessory detachable mechanism according to the present invention. Excavators have been typically employed for earth work or construction work. A conventional excavator has an arrangement in which an accessory like a bucket or breaker is connected to the tip end of the arm. When the arm and the accessory are vertically swung by a hydraulic cylinder, earth and sand are dug out for forming holes or drains.

However, the excavator is used not only for digging holes or drains, but may be diverted to other projects which require different accessories. That is, instead of the bucket, another accessory may be connected to the arm so that specific earth work or construction work can be done. For example, the bucket may be selected to have the size adapted for a digging and trenching width, thereby enabling the excavator to work depending on hardness of earth and width of holes or drains. Alternatively, a breaker may be connected to the tip end of the arm or a grip may be employed for carrying out the loading or unloading of objects. A combination of various kinds of these accessories enables the excavator to adapt to various projects, thereby improving the applicability at the construction work site.

Changing accessories is troublesome and requires several people. Firstly, the bucket attached to the tip end of the arm is removed and another accessory for another project is manually connected to the arm. In this manual work, two pins connecting the arm and the bucket are removed to thereby detach the bucket from the arm. Successively, after another accessory is connected to the arm, connecting pins are inserted into the accessory and the arm.

A series of operations for attaching the accessory to or detaching the accessory from the excavator is carried out through tedious human effort. Several operators are involved in the attaching and detaching operations, which impedes the efficiency in the working site. Furthermore, since it takes time to align and replace pins and accessories, it was impossible to maximize replacement of the accessory at the working site.

According to the present invention, it is possible to quickly detach and attach accessories to the arm in order to reduce the numbers of the requisite operators and increase the efficiency of the work in the earth and constructions sites.

If one operator alone can attach the accessory to and detach the accessory from the arm, then the other operators required for replacing the accessory can be eliminated. Furthermore, in the connection between the arm and the accessory, if the connection between the arm and the accessory is made by pin connection using pins which insert shaft holes and not by a mere hooking connection, the connection is improved because less deformation of the mechanism will be achieved even if a great operating force is applied to the accessory and the arm.

Accordingly, in a first attempt to solve the accessory problem, the inventor proposed an accessory detachable mechanism including a pair of holding pawls which are provided at the tip end of the arm and capable of extending and contracting vertically (Japanese Patent Application No. 2-196763 and No. 2-250697). Similarly, a pawl is provided at the upper side of the tip end of the arm and a connecting pin, which can be stretchable rightward and leftward, is provided at the lower portion of the pawl (Japanese Patent Application No. 2-243203 and No. 2-243204). Furthermore, the inventor proposed a structure in which the arm has a horizontal groove which is open at the tip end thereof and a connecting rod fixed to the accessory is inserted inside the horizontal groove so as to be gripped by the horizontal groove after hooking the accessory by a pawl provided at the upper portion of the tip end of the arm (Japanese Patent Application No. 2-305558).

In these related arrangements as disclosed in copending U.S. Ser. No. 07/735 385, the arrangement is complex and the pawl is deformed if a great operating force is applied to the accessory. Furthermore, the arm and the accessory are frequently turnably operated and it is preferable that the arm and the accessory are connected by the pin connection.

It is desired to develop an accessory detachable mechanism for a construction machine capable of easily connecting the accessory to the arm, of simplifying the positioning of the pin holes through which the connecting pins are inserted and of connecting the accessory to the arm by pin connection. Furthermore, if desired, it is preferable that the accessory is connected to the arm by pin connection at two portions in front and rear portions of the accessory. The accessory is normally connected to the arm by the link mechanism in which both the accessory and the arm can be swingably connected to each other so that the angle between the accessory and the arm can be varied during the operation of the specific work object. Accordingly, if the operating force is applied to the accessory, this force is concentrated on the connecting portion whereby the connecting member is liable to deform if connected by only one connecting pin. Therefore, in the connecting mechanism between the accessory and the arm, it is preferable that the accessory and the arm are connected by pin connection at two or more portions thereof.

SUMMARY OF THE INVENTION

It is a first aspect of the present invention to provide an accessory detachable mechanism of a construction machine comprising a mobile chassis, an arm mounted on the mobile chassis and capable of swinging vertically, and an accessory detachable mechanism attached to the tip end of the arm, the accessory detachable mechanism including links provided at the tip end of the arm and having pin holes at the upper and lower portions thereof through which connecting pins are inserted or removed and swinging links which are swingably connected at the right and left sides of the links and have retaining grooves directed upward, an accessory having pin holes at the four portions at front and rear portions thereof in which axial lines thereof are parallel with each other, retaining rings which are fixed to the inner sides of one pair of the pin holes capable of being inserted into the retaining grooves of the swinging link wherein the interval between the retaining grooves and the pin holes of the links is the same as the interval between the pin holes of the accessory.

According to the first aspect of the present invention, links having pin holes at the upper and lower portions thereof are provided at the tip end of the arm. The swinging links swingable at both outsides of the links are provided at both outsides of the links. The retaining grooves are defined at the upper ends of the swinging links. The accessory has the pin holes defined at the four portions thereof in which the pin holes have axial lines arranged in parallel with each other in addition to the ring shaped retaining rings fixed to one pair of pin holes. When the accessory is mounted on the arm, the swinging links are inclined forward so that the retaining grooves are positioned forward and the retaining rings are inserted into the retaining grooves whereby the pin holes located at the upper portions of the links and the pin holes of the accessory are positioned. The connecting pin is inserted into both the pin holes so that a part of the accessory is connected to the arm. When the links are inclined, the pin holes located at the lower portions of the links and the other pin holes of the accessory are positioned so that these pin holes can be connected by the other connecting pin. In such a procedure, the positioning of the pin holes can be made by only one operator by inserting the retaining rings into the retaining grooves of the swinging links so that the attaching and detaching operations can be made with ease. Furthermore, since the arm and the accessory can be connected by the two upper and lower connecting pins, the swinging operation between the arm and the accessory is smooth and the operating force is distributed among the components which prevents the components from being deformed.

It is a second aspect of the present invention to provide an accessory detachable mechanism of a construction machine comprising a mobile chassis, an arm mounted on the mobile chassis and capable of swinging vertically, and an accessory detachable mechanism attached to the tip end of the arm, the accessory detachable mechanism including a pair of retaining links provided at the tip end of the arm and having substantially U-shaped retaining grooves defined at the upper ends of the retaining links, an accessory having pin holes at the four portions at front and rear portions thereof in which axial lines thereof are parallel with each other, retaining rings which are fixed to inner sides of one pair of pin holes and capable of being inserted into the retaining grooves of the retaining links wherein the interval between the axial lines of the retaining grooves and the pin holes of the retaining links is the same as the interval between the axial lines of the pin holes of the accessory.

According to the second aspect of the present invention, the pair of retaining links are provided at the tip end of the arm and have substantially U-shaped retaining grooves defined at the upper ends thereof. The retaining grooves are adjacent to pin holes having diameters of which are smaller than inner diameters of the retaining grooves. The accessory has the pin holes defined at the four portions thereof in which the pin holes have axial lines arranged in parallel with each other. The retaining rings are fixed to one pair of pin holes. When the accessory is mounted on the arm, the retaining links are inclined forward so that the retaining grooves are positioned forward and the retaining rings are inserted into the retaining grooves. As a result, when the retaining rings are positioned at the innermost portions of the retaining grooves, the axial line of one pair of pin holes of the accessory conform to the axial line of the pin holes in the retaining grooves. In this state, the connecting pin can be inserted into the pin holes. When the retaining links are thereafter pulled, other pin holes of the accessory conform to the other pin holes of the retaining links so that these other pin holes can be connected to each other by inserting the connecting pins. In such a procedure, the positioning of the pin holes can be made by only one operator with ease. Furthermore, since the arm and the accessory can be connected by the two connecting pins, the swinging operation between the arm and the accessory can be smoothly made. Even if a great stress is applied to the accessory, the stress is not concentrated to hence prevent the components from being deformed. Furthermore, the number of the components of the mechanism is reduced compared with the conventional connecting system, which simplifies the manufacture and the assembly of the mechanism.

It is a third aspect of the present invention to provide an accessory detachable mechanism of a construction machine comprising a mobile chassis, an arm mounted on the mobile chassis and capable of swinging vertically, and an accessory detachable mechanism attached to the tip end of the arm, the accessory detachable mechanism including a pair of connecting links provided at the tip end of the arm and having pin holes at the upper and lower portions thereof through which connecting pins are inserted or removed, the connecting links further having retaining pawls provided at the upper front ends thereof which are directed upward and retaining grooves defined between the connecting links and the retaining pawls, the accessory having pin holes at the four portions at front and rear portions thereof and a retaining pin fixed thereto so as to be parallel with the pin holes.

According to the third aspect of the present invention, the pair of connecting links are provided at the tip end of the arm and have pin holes at the upper and lower portions thereof and retaining pawls at the upper front ends thereof which are directed upward and retaining grooves defined between the retaining links and the retaining pawls. The accessory has the four pin holes and the retaining pin fixed thereto. Accordingly, the retaining pin is inserted into the accessory and the connecting links to thereby connect both the accessory and the connecting links after the retaining pin is hooked by the retaining grooves by swinging the arm and then the connecting links and the accessory are positioned to each other. In this state, since the arm and the accessory are already connected by two connecting pins, the connection between both the arm and the accessory is strengthened, whereby the mechanism is free of deformation at the connecting portion even if a great external force is applied to the accessory. In such a procedure, the positioning of the connecting links and the pin holes of the accessory can be made by a single operator. Accordingly, various accessories can be detachably mounted on the tip end of the arm with ease. Furthermore, since the arm and the accessory can be connected by the two connecting pins, the accessory adapted for specific work object can be quickly replaced to thereby improve the working efficiency.

DETAILED DESCRIPTION

First Embodiment (FIGS. 1 to 9)

An accessory detachable mechanism of a construction machine according to a first embodiment of the present invention will be described with reference to FIGS. 1 to 9.

Figure 1:
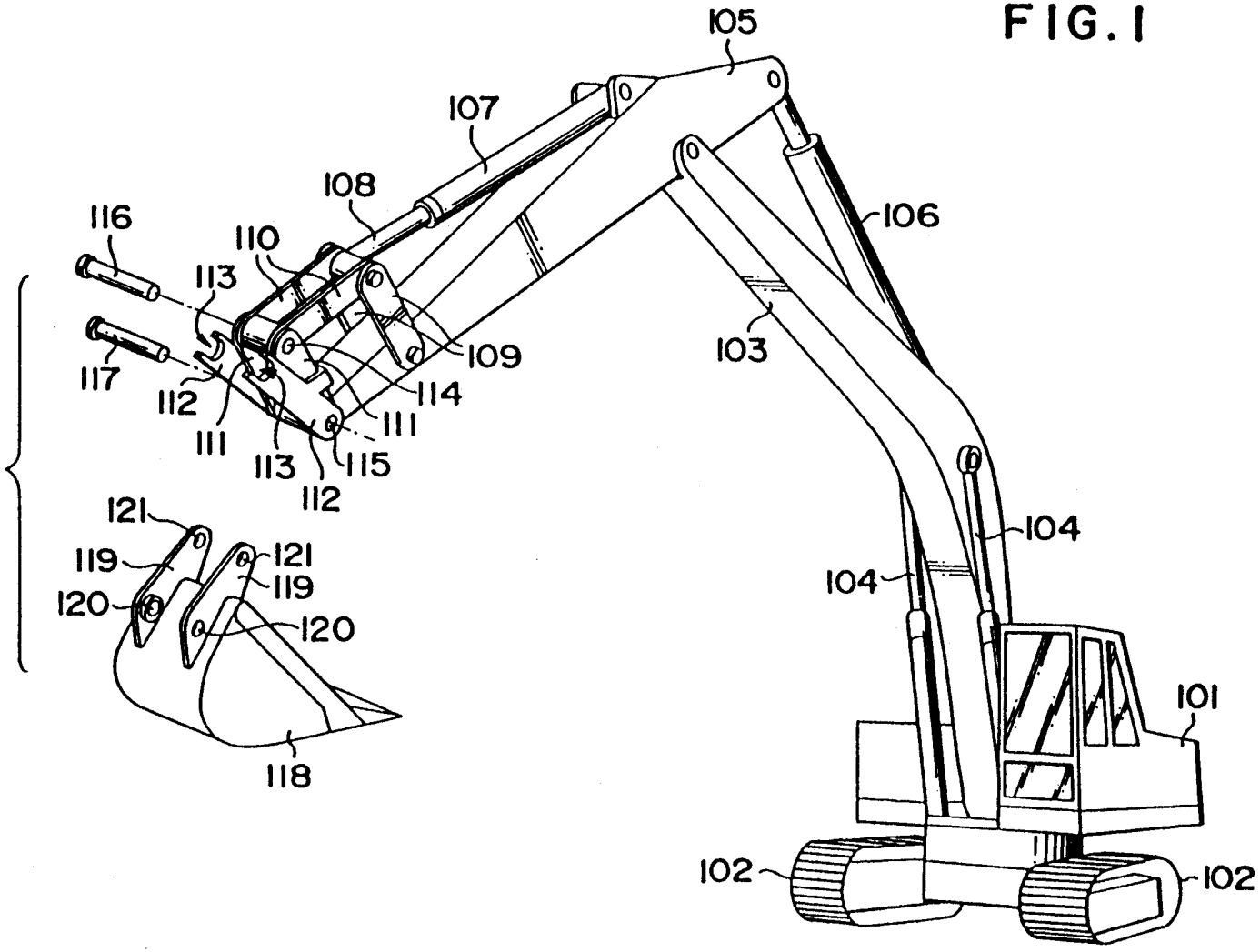
FIG. 1 is a perspective view showing an entire arrangement of the mechanism for connecting a bucket to an arm of an excavator according to a first embodiment of the present invention.
Figure 2:
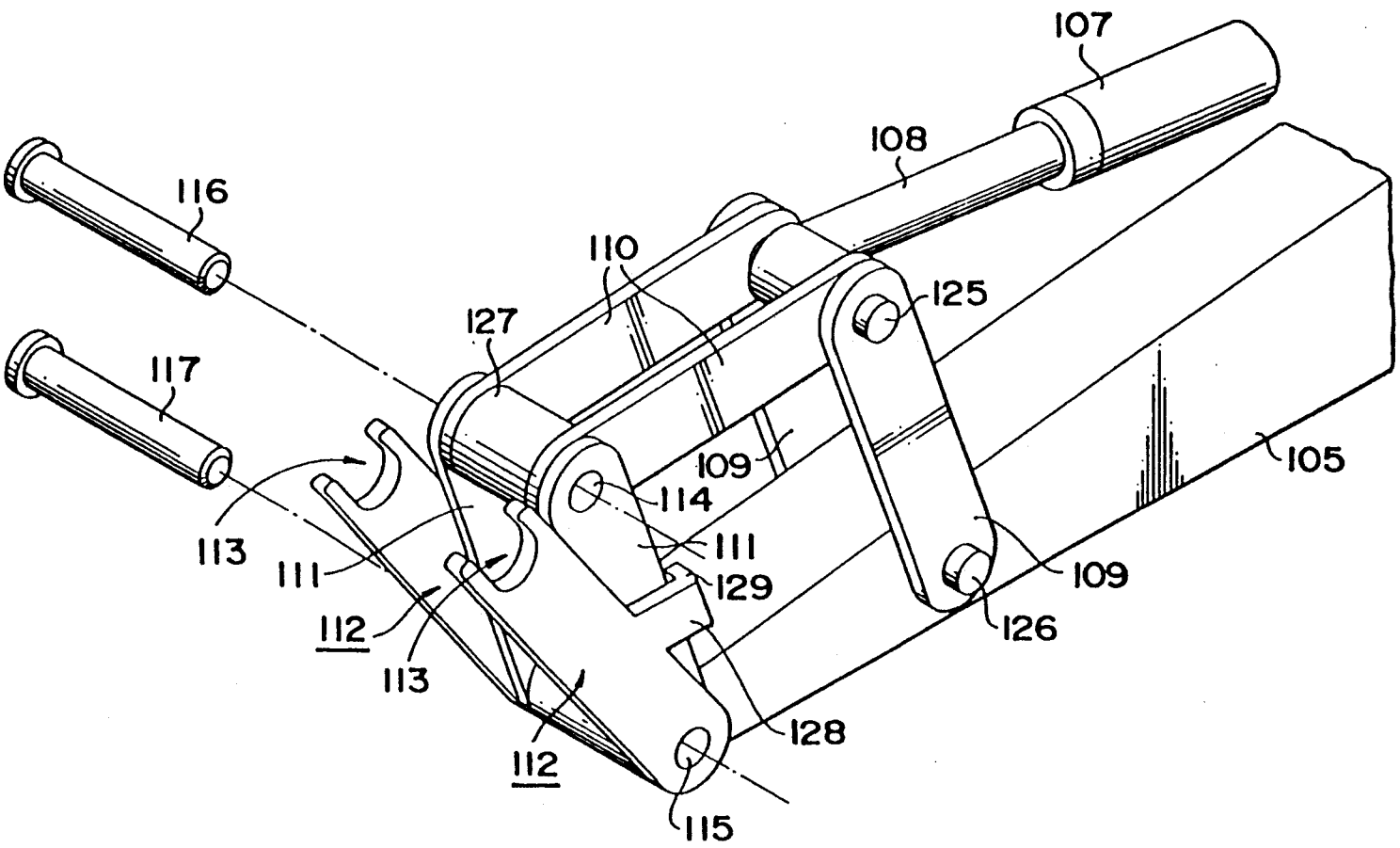
FIG. 2 is an enlarged perspective view showing the arrangement of each component adjacent to the tip end of the arm.
Figure 3:
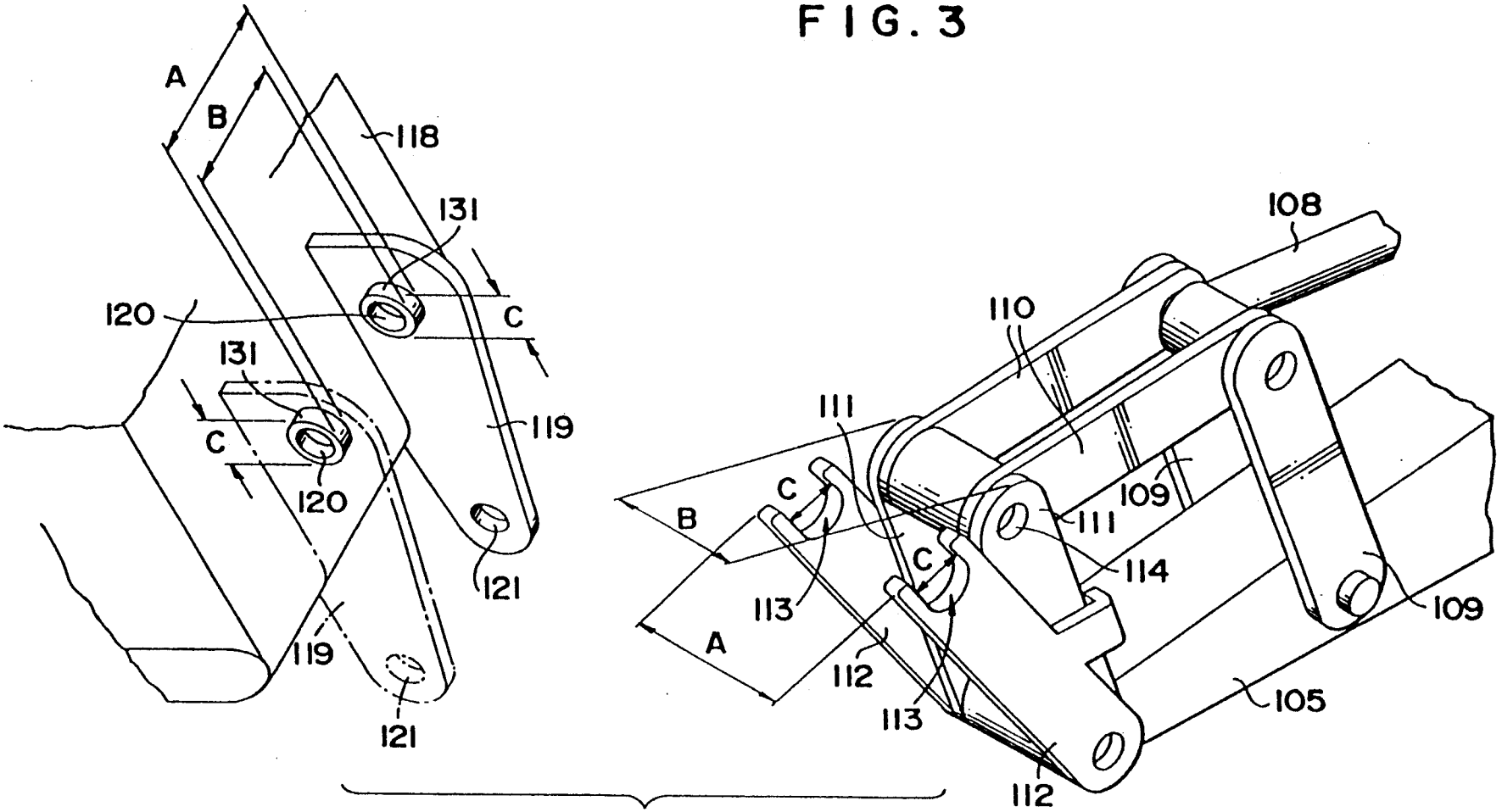
FIG. 3 is an enlarged perspective view showing a mechanism adjacent to the tip end of the arm and a mechanism of the bucket.
Figure 4:
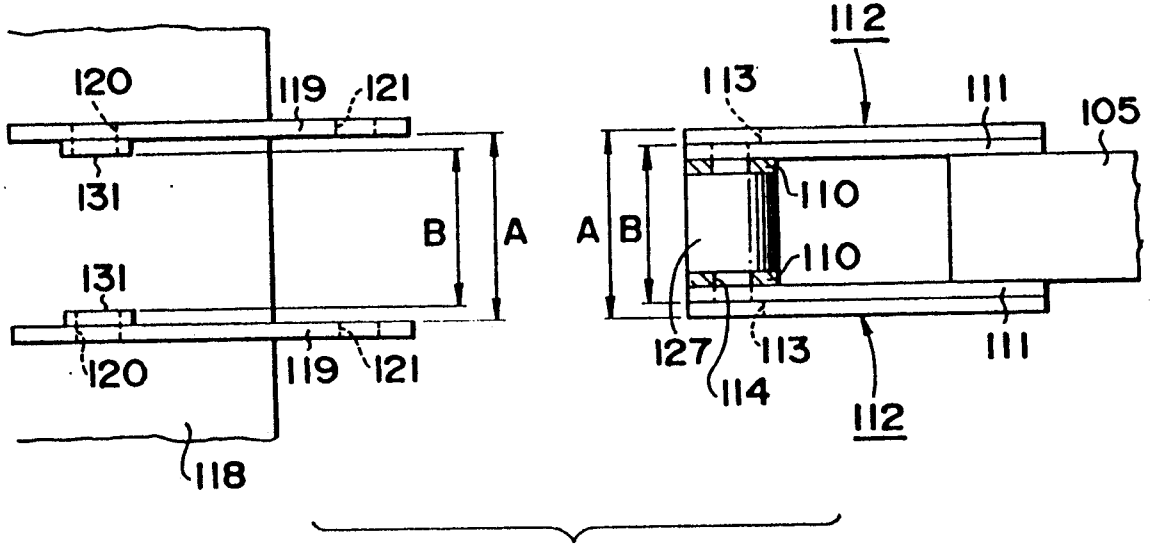
FIG. 4 is a plan view showing the relation between the portion adjacent to the arm and the attached bodies of the bucket.
Figure 5:
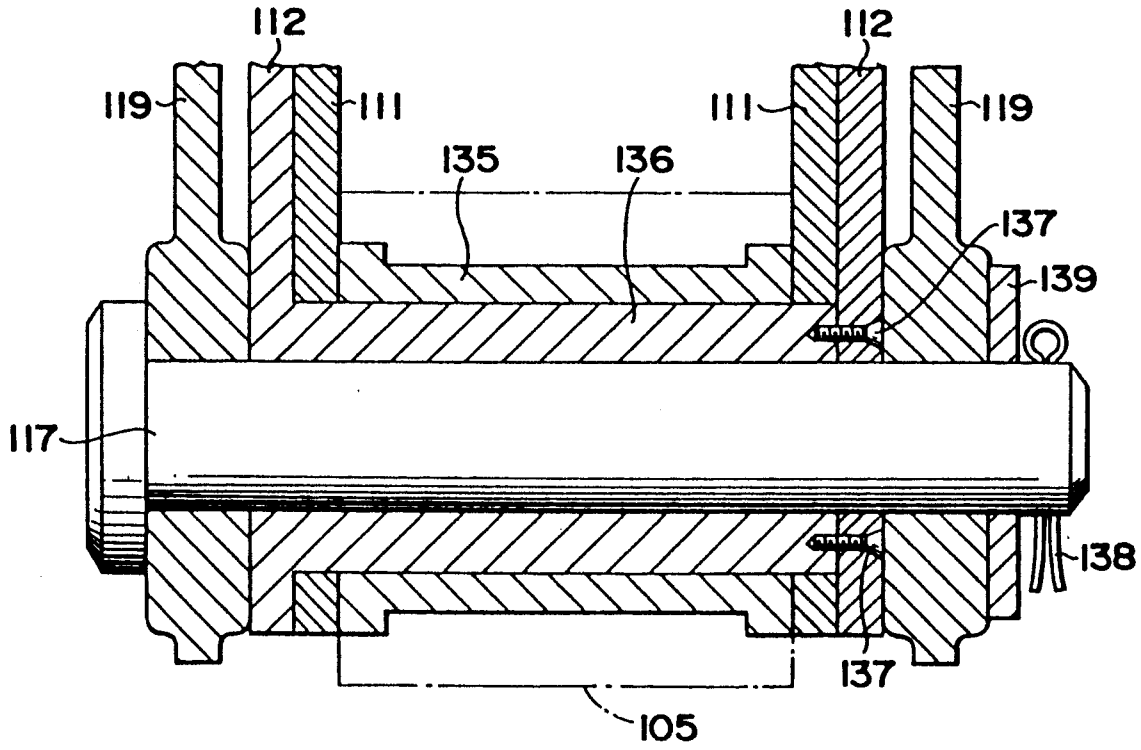
FIG. 5 is a cross-sectional view showing the bucket attached to the tip end of the arm.
Figure 6:
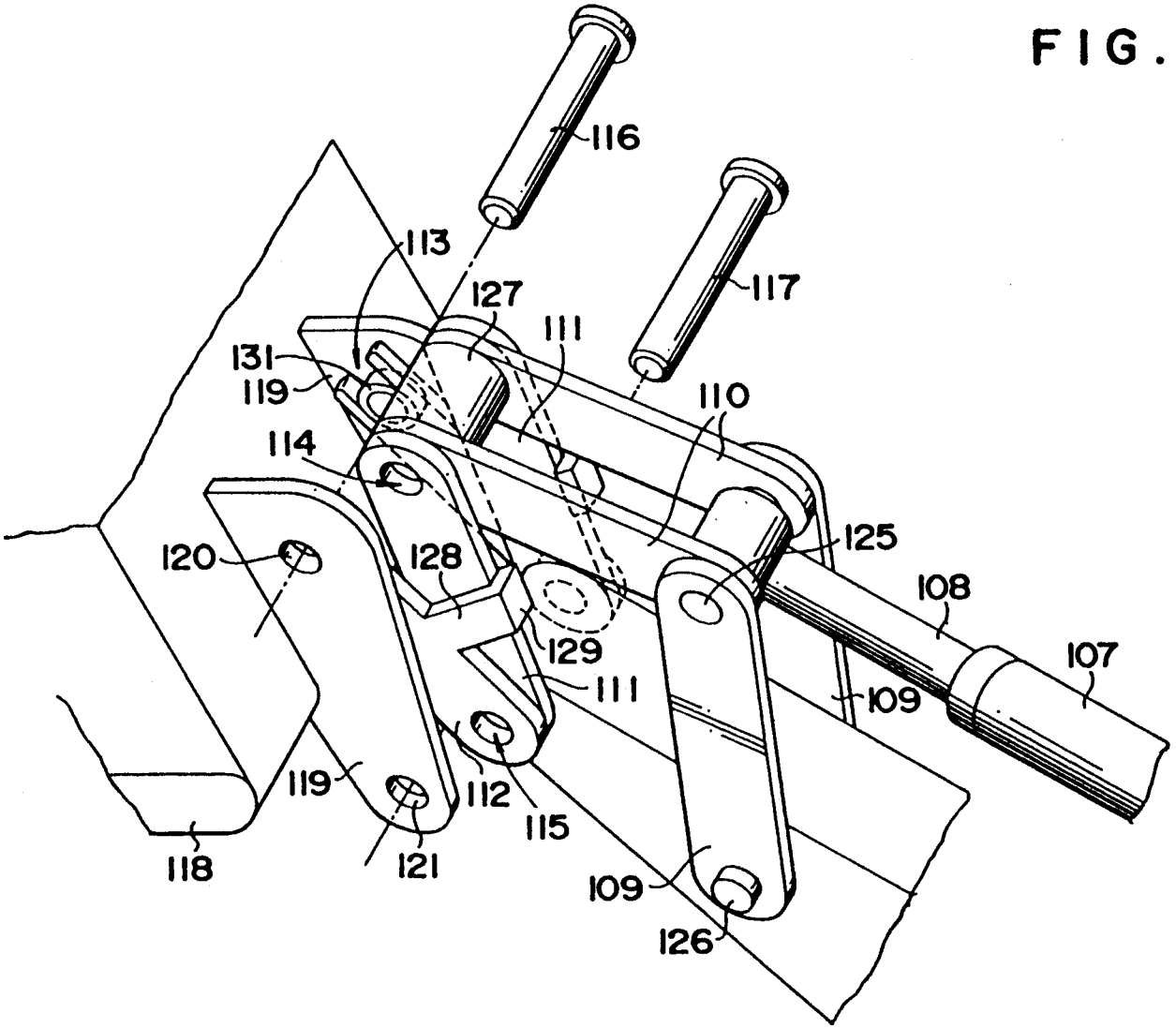
FIG. 6 is a perspective view showing one positional relation between the arm and the bucket.

In the first embodiment, FIG. 1 is a perspective view of an excavator as a whole in which an accessory detachable mechanism is provided at the tip end of an arm, FIG. 2 is an enlarged view showing the tip end portion of the arm of an excavator, FIG. 3 is a plan view showing the shapes of each component of the arm and the accessory, FIG. 4 is a plan view showing the shape of each component of the arm and the accessory, FIG. 5 is a cross-sectional view of the tip end portion of the arm and FIG. 6 is a perspective view showing the state where the accessory is hooked by the arm.

The construction machine comprises a mobile chassis 101 having an engine and the like mounted thereon and an endless track 102 at right and left sides of the lower portion thereof and capable of freely moving front and rear, left and right. The mobile chassis 101 has a boom 103 having a substantially C-shaped configuration and attached to the front portion thereof so as to be vertically swingable. There are provided a pair of hydraulic cylinders 104 connected between the boom 103 at right and left sides of the substantially central portion thereof and the front portion of the mobile chassis 101, whereby the boom 103 can be vertically swung by the operation of the hydraulic cylinders 104.

An arm 105 is connected to an upper end of the boom 103 so as to be vertically movable. A hydraulic cylinder 106 is interposed between a central portion of the boom 103 at the rear surface thereof and the rear end of the arm 105, whereby the arm 105 can be vertically swung relative to the boom 103 by the operation of the hydraulic cylinder 106. A bucket cylinder 107 has a rear end pivotally connected to a rear central portion of the arm 105 while rising links 109 are pivotally connected to the right and left sides of the cylinder rod 108 of cylinder 107. Lower ends of the rising links 109 are pivotally connected to a portion adjacent to the tip of the arm 105 at both sides thereof.

A pair of connecting links 110 are pivotally connected to the tip end of the cylinder rod 108 in parallel with each other and the arm 105. Operating links 111 are disposed in parallel with each other between the tip ends of the connecting links 110 and the tip end of the arm 105 and they are swingably connected to each other. A pivotal link mechanism is formed by the arm 105, the rising links 109, the connecting links 110 and the operating links 111. Swinging links 112 are connected to both sides of the operating links 111 so as to swing forward and backward. Retaining grooves 113 are defined on the upper ends of the swinging links 112 and open substantially in U-shape in the upper directions thereof.

Operating links 111 have pin holes 114 and 115 which are pierced rightward and leftward at the lower and upper ends thereof. The position of the pin holes 115 conform to the rotary axial lines between the operating links 111 and the arm 105 and the rotary axial line of the swinging links 112 relative to the operating links 111. Connecting pins 116 and 117 are slidably inserted into these pin holes 114 and 115.

A bucket or other accessory 118 as illustrated in FIG. 1 has a pair of flat-shaped attached bodies 119 which are fixed to an outer periphery of the bucket 118 in parallel with each other. The attached bodies 119 have pairs of pin holes 120 and 121 at the respective front and rear portions thereof. An axial line of pin holes 120 is arranged to be parallel with that of pin holes 121. The interval between the axial line of the pair of pin holes 120 and that of the pair of pin holes 121 conforms to the interval between the pin holes 114 and 115 of the operating links 111.

FIG. 2 is an enlarged view showing the accessory detachable mechanism which is positioned adjacent to the tip end of the arm 105.

A pin 125 is inserted into the tip end of the cylinder rod 108 and pivotally connects links 110 at the right and left sides of the cylinder rod 108. The rising links 109 are pivotally connected by the pin 125 to the right and left sides of the connecting links 110. The rising links 109 extend downward and have lower ends which are pivotally connected to the portion adjacent to the tip end of the arm 105 by pin 126. The operating links 111 are disposed at right and left sides of the tip end of the arm 105 and extend upward. The upper ends of the operating links 111 are pivotally connected to the tip ends of the connecting links 110 while a collar 127 is interposed between the tip ends of the pair of connecting links 110. Pin holes 114 pierce the connecting links 110 and the collar 127.

The swinging links 112 are pivotally connected coaxially to the lower end of the operating links 111 at the right and left sides thereof. Pin holes 115 pierce the swinging links 112, the operating links 111 and the arm 105. Accordingly, the operating links 111 and the swinging links 112 are coaxially connected to each other so as to be swingable about the pin hole 115. Stoppers 128 protrude from the rear central portion of the swinging links 112 (right side in FIG. 2) and extend in the direction of the center of the arm 105. The stoppers 128 are bent inwardly in an L-shape at the tip ends thereof for forming stopping portions 129. The stopping portions 129 can contact the central side surfaces of the operating links 111 and restrict the swinging motion of the swinging links 112, namely, restrain the swinging links 112 not to incline forward over a predetermined angle. The swinging links 112 are recessed at the upper ends thereof so as to form U-shaped retaining grooves 113. The interval between the retaining grooves 113 and the axial line of the pin holes 115 conforms to an interval between the axial lines of the pin holes 114 and 115.

FIG. 3 is an enlarged view showing the relation between the attached bodies 119 fixed to the bucket 118, the operating links 111 and the swinging links 112 The pair of flat-shaped attached bodies 119 are fixed to a rear surface of the bucket 118 in a given interval. An internal interval of the attached bodies 119 is set to be A. Retaining rings 131 are fixed to the inner surfaces of the attached bodies 119 in the position coaxial with the pair of pin holes 120. The retaining rings 131 have inner diameters which are the same as the diameters of the pin holes 120 and outer diameters which are set to be C. The pin holes 120 have inner diameters through which the connecting pin 116 is inserted.

An interval of the right and left operating links 111, which are connected to the tip end of the arm 105, is set to be B while an interval between the right and left swinging links 112 is set to be dimension A. The retaining grooves 113, defined in the swinging links 112, have inner diameters which are set to be dimension C and the same as the outer diameters of the retaining ring 131.

FIG. 4 is a plan view showing the relation between the dimensions A, B and C between the components as illustrated in FIG. 3. As evident from this figure, the entire swinging links 112 can be inserted into the space between the attached bodies 119 while the retaining rings 131 can be inserted into the retaining grooves 113 defined in the swinging links 112. The configurations of the operating links 111 are set in the manner that they can slide between the retaining rings 131.

FIG. 5 is a cross-sectional view showing the portion adjacent to the tip end of the arm 105 and showing the state where the connecting pin 117 is inserted into the pin holes 115 and 121 and the bucket 118 is connected to the tip end of the arm 105. A shaft supporter 135 is fixed to the tip end of the arm 105. The shaft supporter 135 is pierced inside thereof to form an opening hole. The operating links 111 are brought into contact with both sides of shaft supporter 135 at the lower surfaces thereof. A cylindrical bearing 136 is fixed to the lower surface of one of the swinging links 112. The bearing 136 is inserted into the opening of the shaft supporter 135 and has a tip end which protrudes through the operating links 111 and is exposed to other side of the arm 105. The other swinging link 112 is brought into contact with the tip end of the bearing 136 at the lower surfaces thereof while the bearing 136 and the swinging links 112 are connected to each other by screws 137.

Both swinging links 112 can be turned forward and backward by the bearing 136 about the shaft supporter 135 and the operating links 111 can be freely turned along the outer periphery of the bearing 136. That is, the operating links 111 and the swinging links 112 can be turned on the coaxial lines thereof at the tip end of the arm 105. The pierced opening hole in the center of the bearing 136 corresponds to the pin holes 115. The inner walls of the attached bodies 119 contact both sides of the swinging links 112 and the connecting pin 117 is inserted into the pin holes 121 and 115 whereby the attached bodies 119 and the arm 105 are connected to each other. A washer 139 is inserted into the tip end of the connecting pin 117 which is inserted into the pin holes 121 and 115 while a split pin 138 is inserted into the tip end of the connecting pin 117 perpendicular to the lengthwise of the connecting pin 117.

Figure 7:
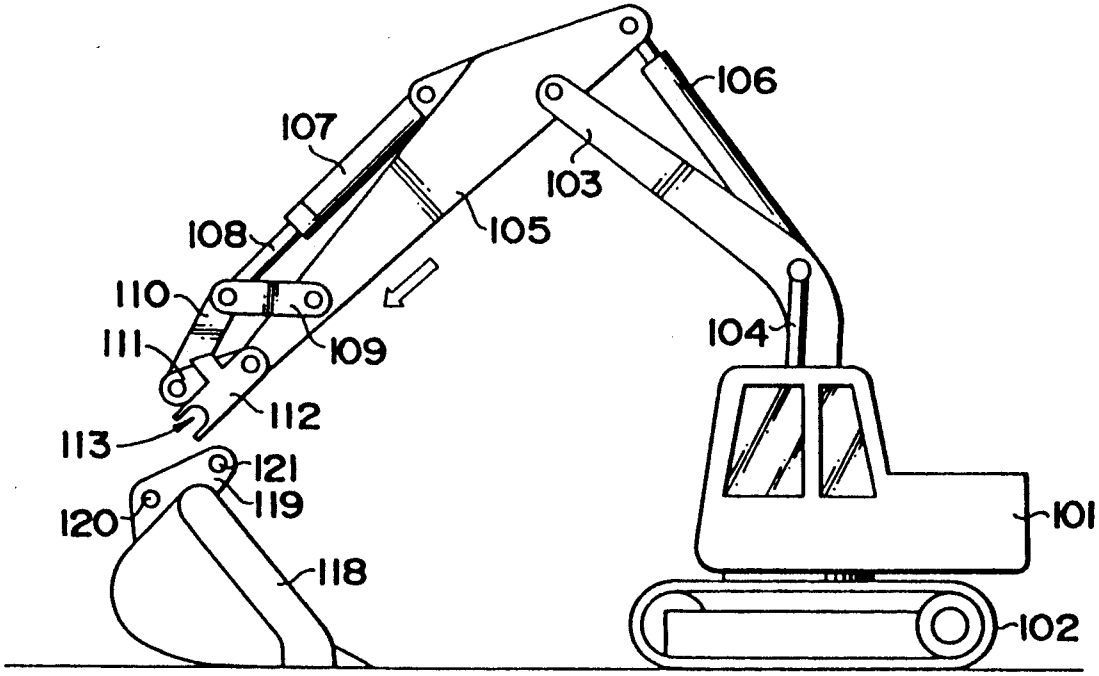
FIG. 7 is a view showing the tip end of the arm approaching the bucket.

Procedures for mounting the bucket 118 on the tip end of the arm 105 are illustrated in FIGS. 6, 7, 8 and 9. As illustrated in FIG. 7, the bucket 118 is placed on the ground and the operator of the excavator sits on the operator's seat of the chassis 101 and operates the boom 103 and the arm 105 so that the operator alone can mount the bucket 118 on the arm 105.

FIG. 7 is a view showing the state where the accessory for construction work (the bucket 118 is this case) is not attached to the tip end of the arm 105 and the operation to mount the bucket 118 on the tip end of the arm 105 starts.

Before starting the mounting operation, the bucket cylinder 107 is operated to extend the cylinder rod 108 at its maximum so that the operating links 111 are inclined as far as possible to the front portion thereof. In this state, the swinging links 112 turns about the shaft supporter 135 by its own weight so that the swinging links 112 are inclined at the front side of the operating links 111. At this time, the stopping portions 129 defined on the swinging links 112 contact the side surfaces of the operating links 111 to thereby restrain the operating links 111 from opening to the extent exceeding a prescribed angle. As a result, both the operating links 111 and the swinging links 112 open like a fan so that the retaining grooves 113 defined on the upper ends of the swinging links 112 are directed forward as illustrated in FIG. 7.

At this state, when the hydraulic cylinders 104 and 106 are cooperatively operated, both the boom 103 and the arm 105 are vertically swung to thereby permit the tip end of the arm 105 to approach the attached bodies 119 of the bucket 118. Accordingly, the pair of swinging links 112 can be inserted into the space of the attached bodies 119 as illustrated in FIG. 7. As illustrated in FIGS. 3 and 4, the interval between the inner walls of the attached bodies 119 is set to be A and the interval between the outer surfaces of the swinging links 112 is also set to be A so that the swinging links 112 can be inserted into the space of the attached bodies 119 (refer to FIG. 6). As the boom 103 and the arm 105 are further swung vertically, the retaining rings 131 are permitted to contact the retaining grooves 113 so that the retaining rings 131 are inserted into the retaining grooves 113. The inner diameters of the retaining grooves are set to be C and the outer diameters of the retaining rings 131 are set to be C.

Figure 8:
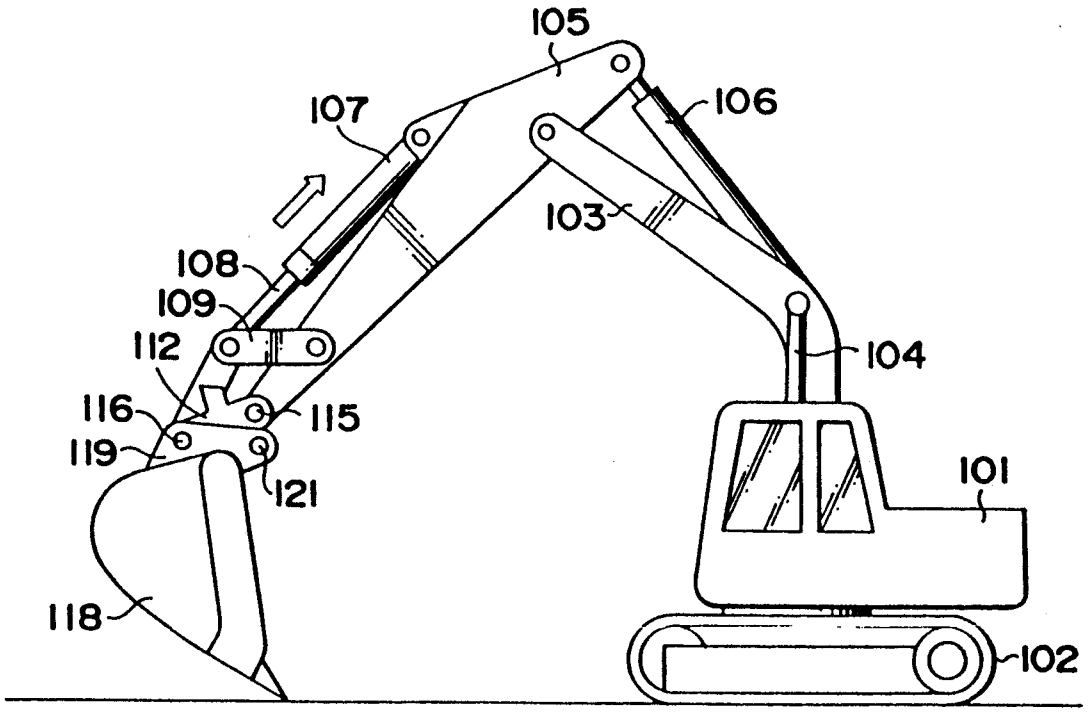
FIG. 8 is a view showing the bucket connected to the arm by one connecting pin.

Thereafter, both the hydraulic cylinders 104 and 106 are cooperated to thereby lower the arm 105 so that the retaining rings 131 are inserted into the innermost portions of the retaining grooves 113. Further lowering operation of the arm 105 permits the swinging links 112 to turn relative to the operating links 111 so that the operating links 111 are inserted into the space of the attached bodies 119. Consequently, the pin holes 114 of the operating links 111 are positioned at the position where the pins 120 of the retaining rings 131 are located whereby the axial line of the pin holes 120 of the retaining rings 131 conform to the axial line of the pin holes 114 of the operating links 111. At this state, the connecting pin 116 is inserted into the pin holes 120 from one of the side surfaces of the attached bodies 119 so that the connecting pin 116 is inserted into the pin holes 120 and 114. Accordingly, the connecting links 110, operating links 111 and the attached bodies 119 are connected to the attached bodies 119 by the connecting pin 116. FIG. 8 is a view showing the state where the bucket 118 is connected to the connecting point between the connecting links 110 and the operating links 111 by inserting the connecting pin into the connecting point.

Figure 9:
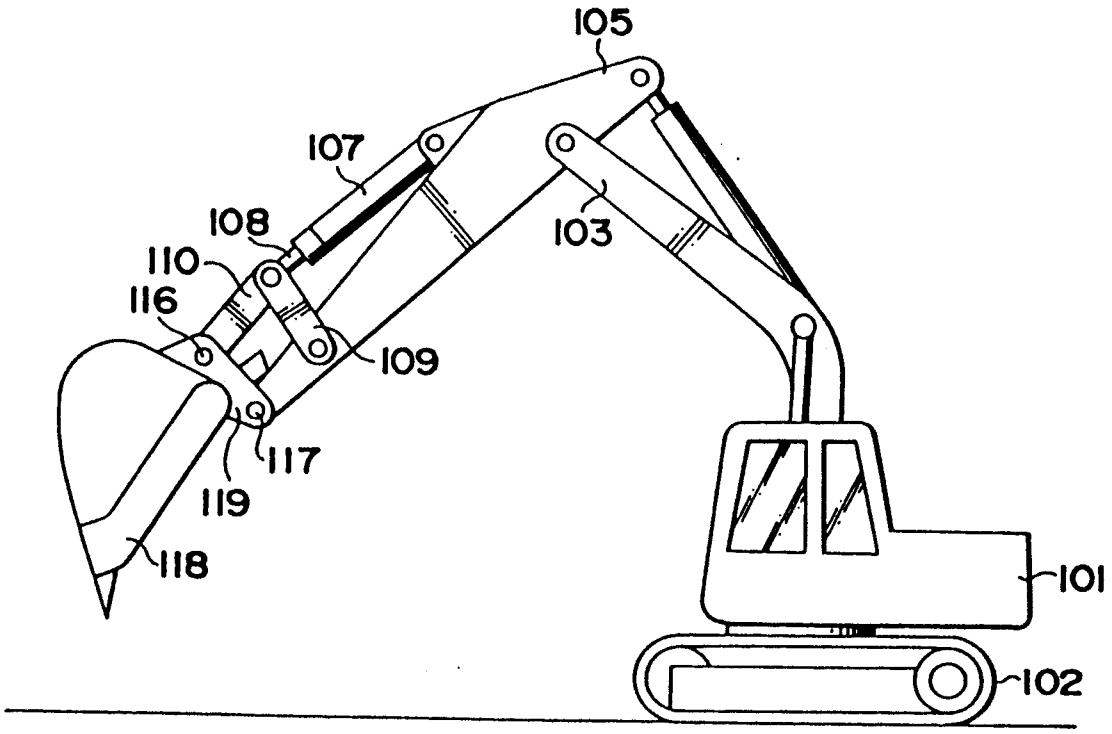
FIG. 9 is a view showing the bucket connected to the arm by two connecting pins.
Figure 10:
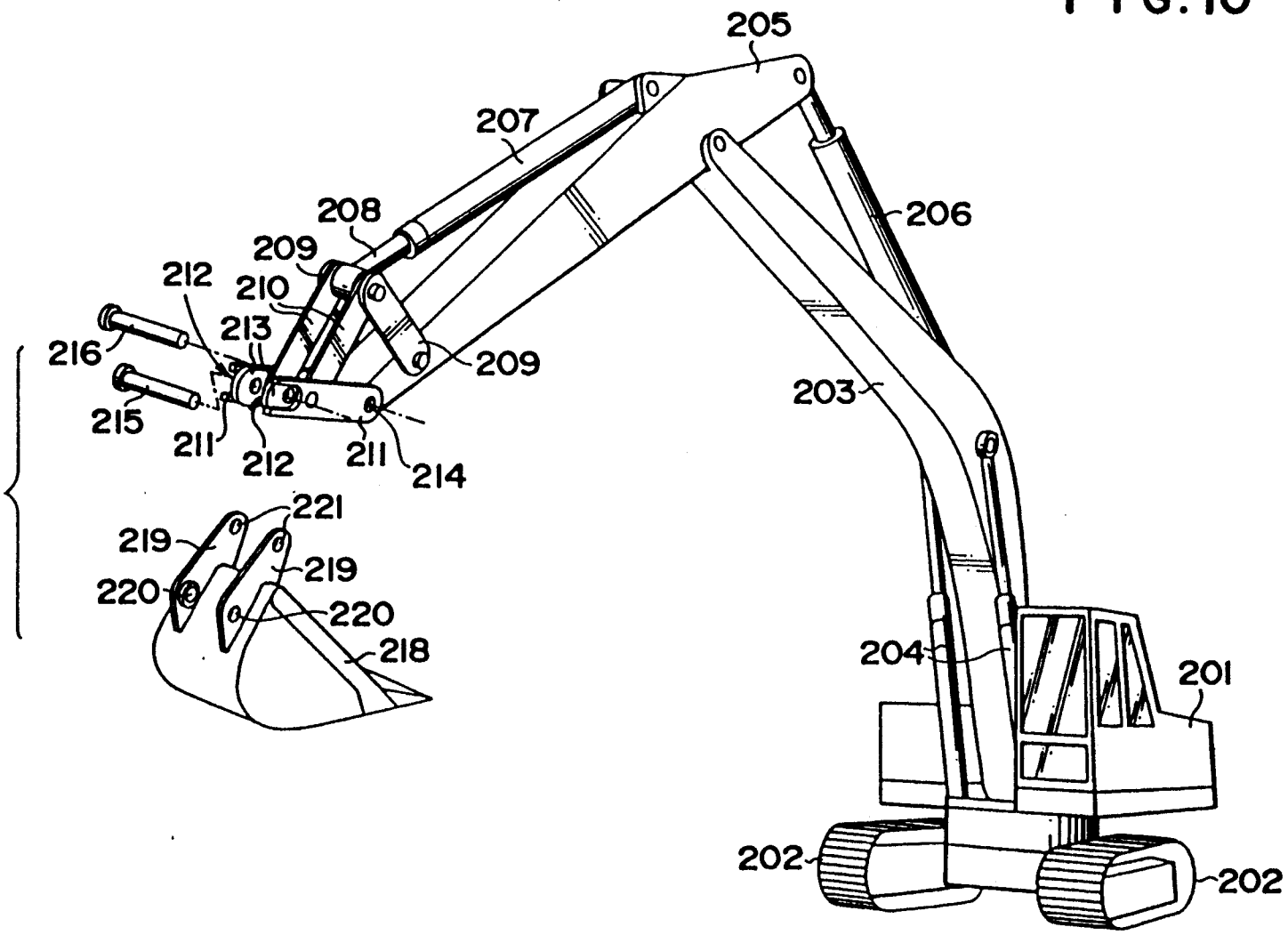
FIG. 10 is a perspective view showing the mechanism for connecting a bucket to an arm of an excavator according to a second embodiment of the present invention.

After the pin holes 114 and 120 are connected by the connecting pin 116, the hydraulic cylinders 104 and 106 are operated, as illustrated in FIG. 9, thereby slightly raising both the boom 103 and arm 105 and slightly pulling up the bucket 118 from the ground. Thereafter, the bucket cylinder 107 is operated to contract the cylinder rod 108 so that the rising links 109 are turned about the pin 126. As a result, the connecting links 110 are interlocked with the rising links 109 so as to pull the operating links 111 which turn about the bearing 136. The bucket 118 is pulled upward as the operating links 111 are turned whereby the bucket 118 is turned counterclockwise by its own weight relative to the operating links 111 as illustrated in FIG. 9. When the bucket 118 approaches the operating links 111, the pin holes 115 approach the pin holes 121 so that the axial line of the pin holes 115 conforms to that of the pin holes 121. Thereafter, the connecting pin 117 is inserted into the pin holes 115 and 121 so that the bucket 118 is connected to the tip end of the arm 105 by the connecting pin 117.

With a series of procedures as set forth above, the bucket 118 can be mounted on the tip end of the arm 105. When the bucket 118 is disconnected from the tip end of the arm 105, the connecting pins 117 and 116 are in turn pulled out from the pin holes in the order of the procedures as illustrated in FIG. 9, FIG. 8 and FIG. 7.

With the arrangement of the first embodiment, it is possible to position the two pin holes defined on the tip end of the arm to the two pin holes defined on the accessory with ease. In addition, it is possible to connect the arm to the accessory by the two connecting pins although the structure thereof is very simple. Both the arm and the accessory can be securely connected to each other by the pins and can be turned smoothly. Accordingly, there is no likelihood of deformation of the components even if the strong external force is applied to the accessory.

Second Embodiment (FIGS. 10 to 18)

An accessory detachable mechanism of a construction machine according to a second embodiment will be described with reference to FIGS. 10 to 18.

The construction machine according to the second embodiment is the same as that of the first embodiment, hence the explanation thereof is omitted. Described hereinafter is mainly the detachable mechanism and the accessory.

A pair of connecting links 210 are pivotally connected to the tip end of the cylinder rod 208 in parallel with each other and directed forward of the arm 205. A pair of retaining links 211 are disposed between the tip ends of the connecting links 210 and the tip end of the arm 205 and they are swingably connected to each other. A link mechanism is formed by the arm 205, the rising links 209, the connecting links 210 and the retaining links 211. In the connection between the tip ends of the connecting links 210 and the retaining links 211, the tip ends of the connecting links 210 are pivotally connected to the substantially central portions of the retaining links 211 by a pin 227 and the upper half portions of the retaining links 211 are directed forward the excavator. Substantially U-shaped grooves 212 are defined at the upper ends of the retaining links 211 in the longitudinal direction thereof. Flat shaped bearing plates 213 are fixed to the inner portions of the retaining links 211 at the innermost position of the retaining grooves 212 by welding or other conventional means of attachment. The bearing plates 213 have pin holes 228 opened therein. Pin holes 214 are pierced in the central axis about which the arm 205 and the retaining links 211 are turned. A connecting pin 215 can be inserted into or removed from the pin holes 214 while connecting pin 216 can be inserted into or removed from the pin holes 228 of the bearing plates 213.

Figure 11:
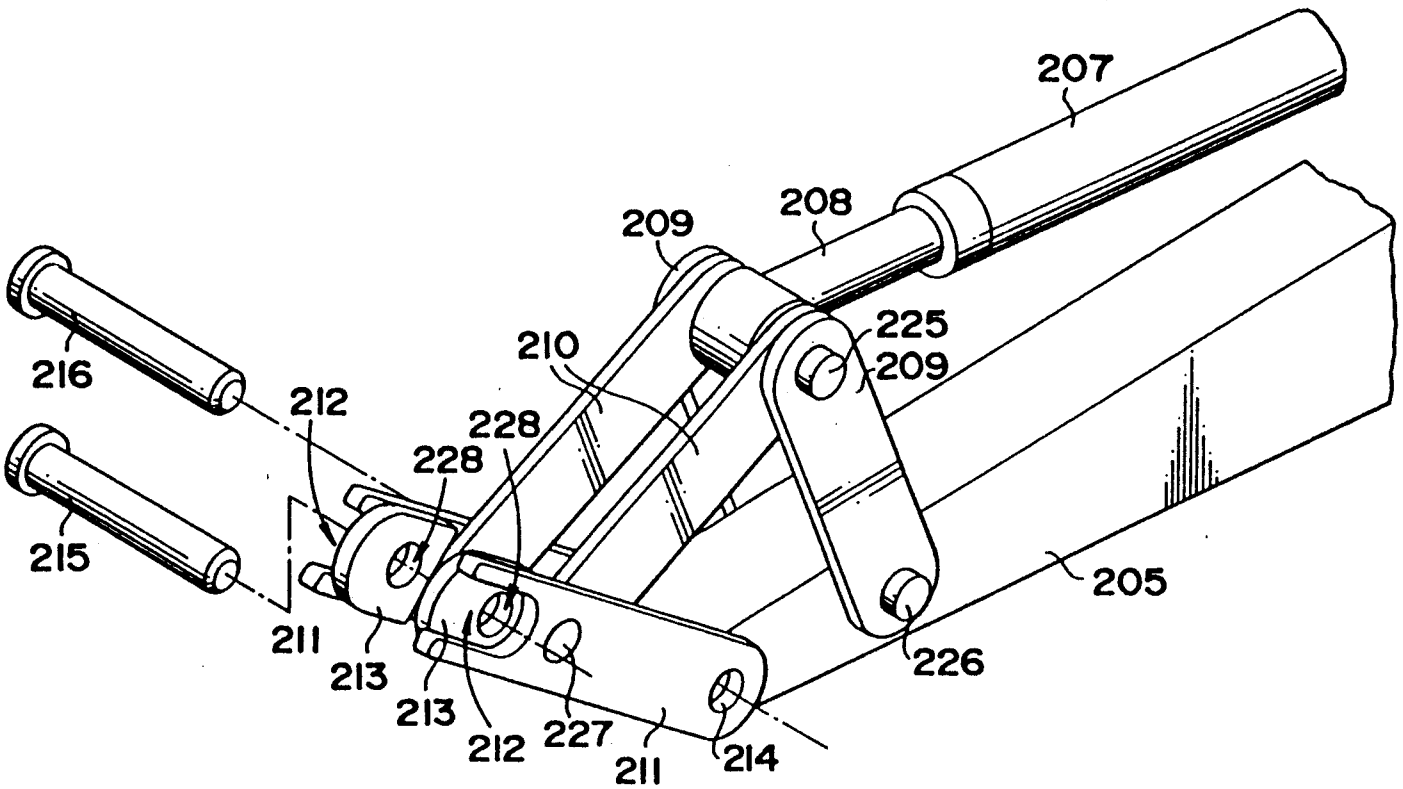
FIG. 11 is an enlarged perspective view showing the arrangement of each component adjacent to the tip end of the arm.

A bucket or other accessory 218 as illustrated in FIG. 11 has a pair of flat-shaped attached bodies 219 which are fixed to an outer periphery of the bucket 218 and parallel with each other. The attached bodies have a pair of pin holes 220 and another pair of pin holes 221 at the front and rear portions thereof. An axial line of the pair of pin holes 220 is arranged to be parallel with that of another pair of pin holes 221. An interval between the axial line of the pair of the pin holes 220 and that of the pair of pin holes 221 conforms to an interval between the axial line of the pin holes 228 of the bearing plates 213 and that of the pin holes 214.

FIG. 11 is an enlarged view showing the accessory detachable mechanism which is positioned adjacent to the tip end of the arm 205. A pin 225 is inserted into the tip end of the cylinder rod 208 and the connecting links 210 are pivotally connected by pin 225 at the right and left sides of the cylinder rod 208. The upper ends of the rising links 209 are pivotally connected by pin 225 at the right and left sides of the connecting links 210. The rising links 209 extend downward and have lower ends which are pivotally connected to the portion adjacent to the tip end of the arm 205 by a pin 226. The lower ends of the retaining links 211 are positioned at the tip end of the arm 205 at right and left sides of the arm 205 while the retaining links 211 extend substantially upward. The middle portions of the retaining links 211 and the tip ends of the connecting links 210 are pivotally connected by the pin 227. The substantially U-shaped retaining grooves 212 are defined on the upper ends of the retaining links 211 and extend downward in the longitudinal directions thereof. The bearing plates 213 are fixed to the inner portions of the retaining links 211 at the positions corresponding to the retaining grooves 212 and have the pin holes 228 opened therein. The axial line of the pin holes 228 conform to an axial core of the semicircular arc positioned at the innermost end of the retaining groove 212.

Figure 12:
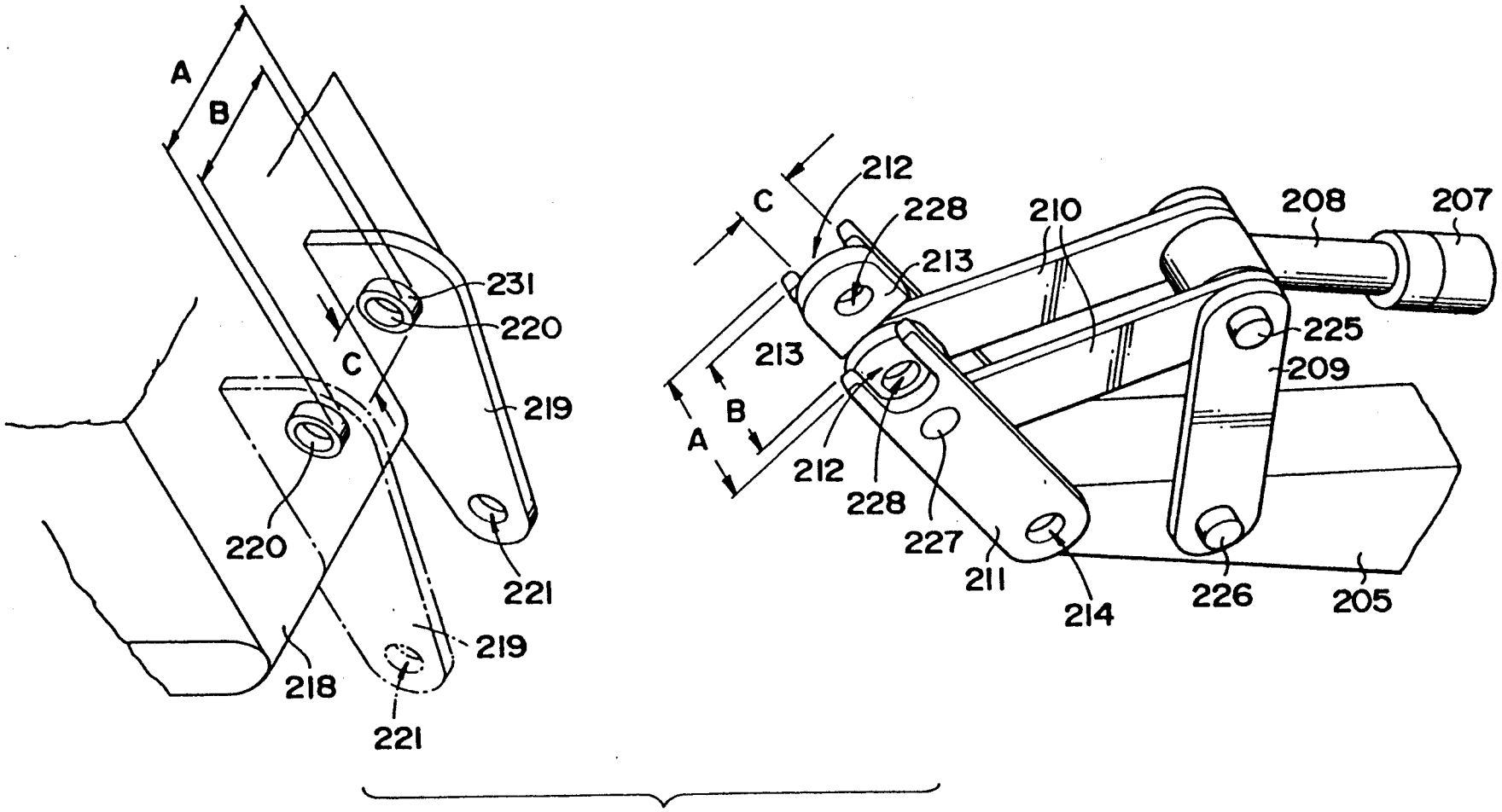
FIG. 12 is an enlarged perspective view showing a mechanism adjacent to the tip end of the arm and a mechanism of the bucket.

FIG. 12 is an enlarged perspective view showing the relation between the attached bodies 219 fixed to the bucket 218 and the retaining links 211. The pair of flat-shaped attached bodies 219 are fixed to a rear surface of the bucket 218. The internal interval of the attached bodies 219 is set to be dimension A. Retaining rings 231 are fixed to the inner surfaces of the attached bodies 219 at the position coaxial with the pair of pin holes 220 and have inner diameters which are the same as the diameters of the pin holes 220 and outer diameters which are set to be dimension C. The inner interval between the confronted two retaining grooves 231 is set to be dimension B.

The interval of the right and left retaining links 211, which are connected to the tip end of the arm 205, is set to be A while an inner interval between the confronted retaining links 211 is set to be B. The retaining grooves 212, defined on the retaining links 211, have groove width which is set to be C. Furthermore, the interval between the axial lines of the pin holes 214 and 228 of the retaining links 211 conform to the interval between the axial lines of the pin holes 220 and 221 of the attached bodies 219.

Figure 13:
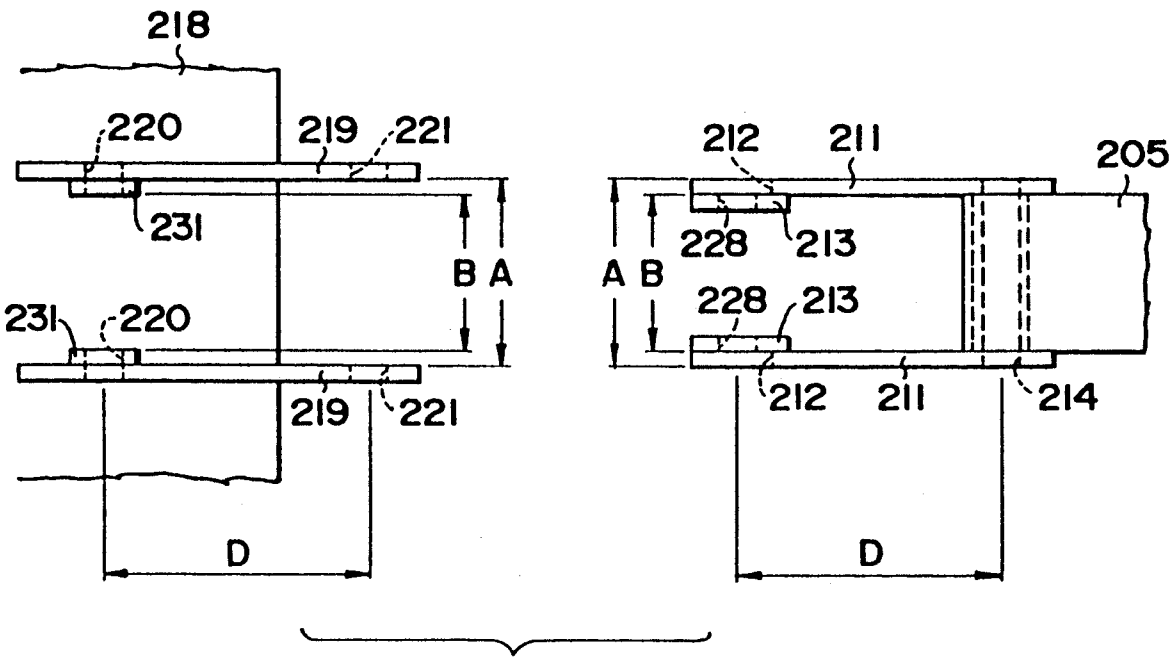
FIG. 13 is a plan view showing the relation between the portion adjacent to the arm and the attached bodies of the bucket.

FIG. 13 is a plan view showing in part the relation between the dimensions or intervals A and B. As evident from this figure, the outer sides of the retaining links 211 can be inserted into the space between inner walls of the attached bodies 219 while the retaining rings 231 can be inserted into the retaining grooves 212 defined on the tip ends of the retaining links 211. The dimension or interval D between the axial lines of the pin holes 214 and 220 is set to be equal to the interval D between the axial lines of the pin holes 220 and 221.

Figure 14:
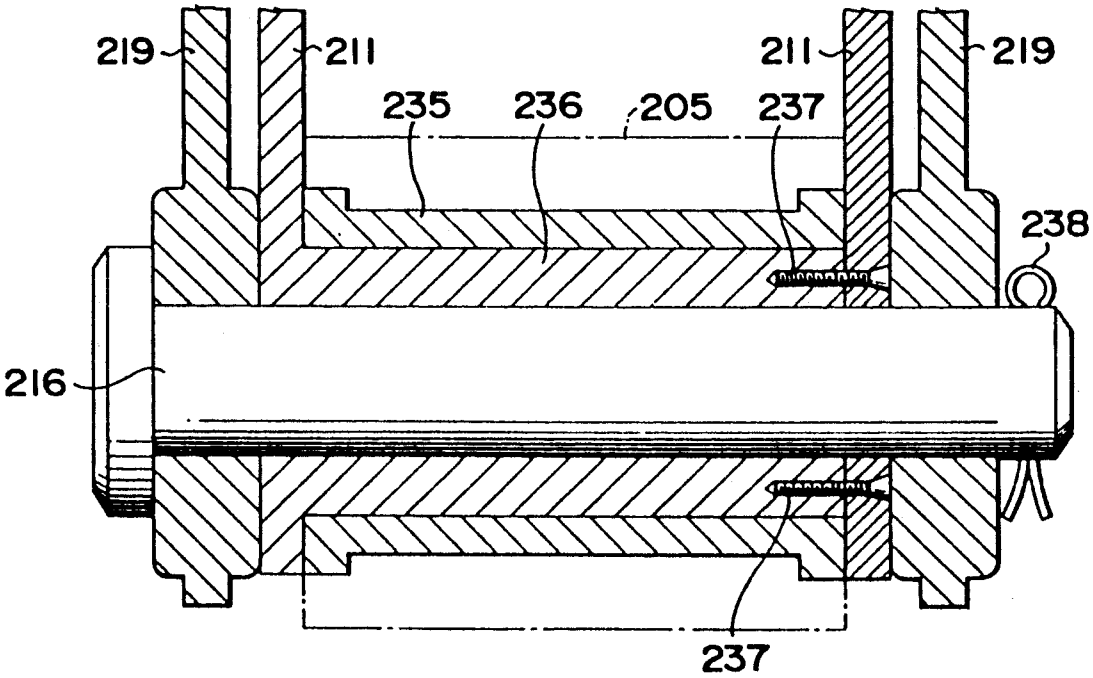
FIG. 14 is a cross-sectional view showing the bucket attached to the tip end of the arm.

FIG. 14 is a cross-sectional view showing the portion adjacent to the tip end of the arm 205 where the connecting pin 216 is inserted into the pin holes 214 and 221 and the bucket 218 is connected to the tip end of the arm 205. A shaft supporter 235 is fixed to the inside of the tip end of the arm 205. The shaft supporter 235 is of a pipe shape having two flange-shaped ends. A cylindrical bearing 236 is fixed to the side surface of one of the retaining links 211. The bearing 236 is slidably inserted into the opening of the shaft supporter 235 and has a tip end which is brought into contact with the side surface of another retaining link 211. The bearing 236 and retaining link 211 are fixedly connected to each other by screws 237. Therefore, the bearing 236 can turn freely relative to the fixed shaft supporter 23 and the retaining links 211 positioned at both sides of the shaft supporter 235 can swing freely relative to the arm 205. A hole pierced inside the bearing 236 corresponds to the pin holes 214. The retaining links 211 are inserted into the space in the attached bodies 219 at both sides thereof and then the connecting pin 216 is inserted into the pin holes 221 and 214 so that the attached bodies 219 are connected to the arm 205. A split pin 238 is inserted into the tip end of the connecting pin 216 which is inserted into the pin holes 221 and 214 to thereby prevent the connecting pin 216 from dropping out of the attached bodies 219.

Figure 15:
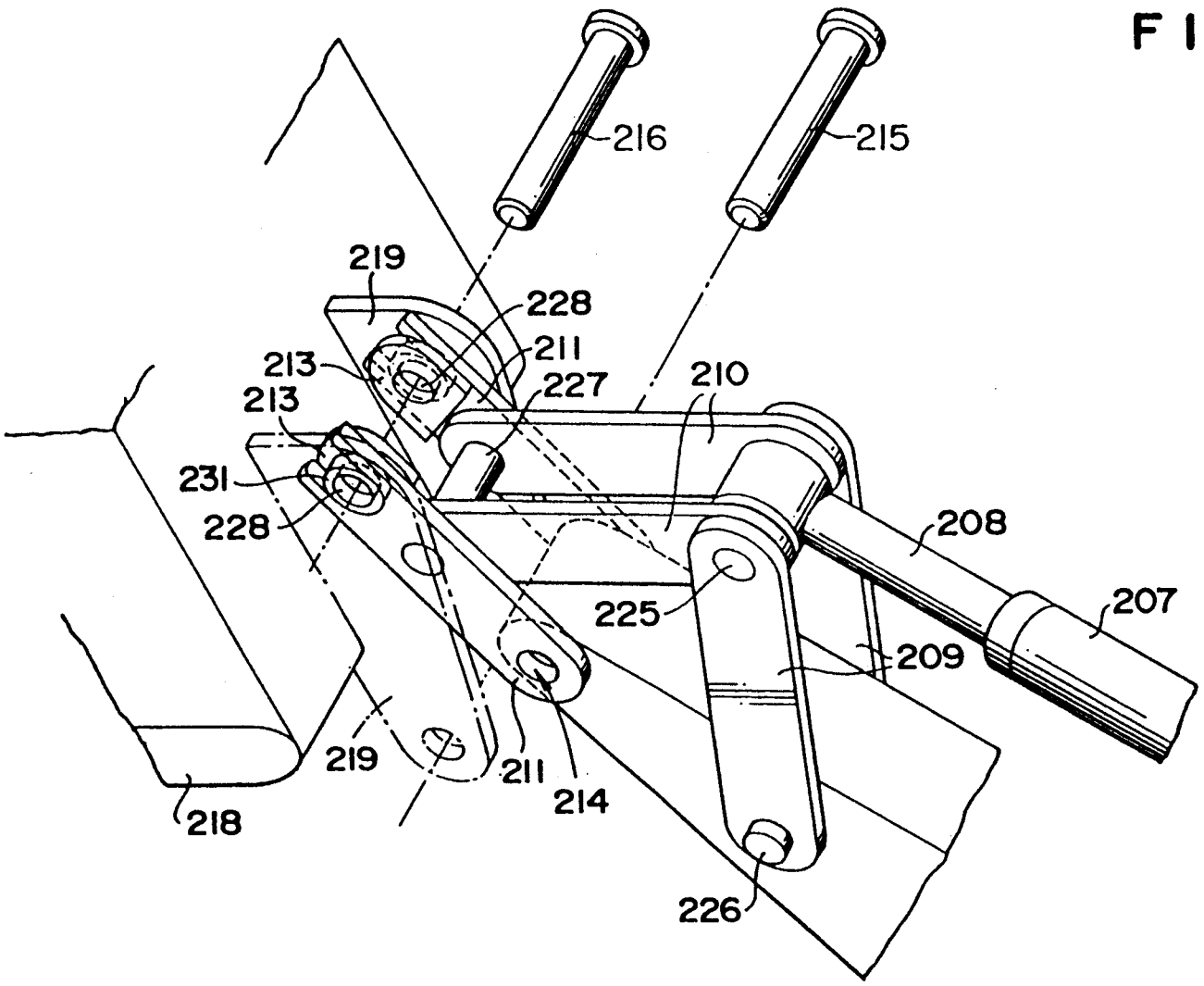
FIG. 15 is a perspective view showing one positional relation between the arm and the bucket.
Figure 16:
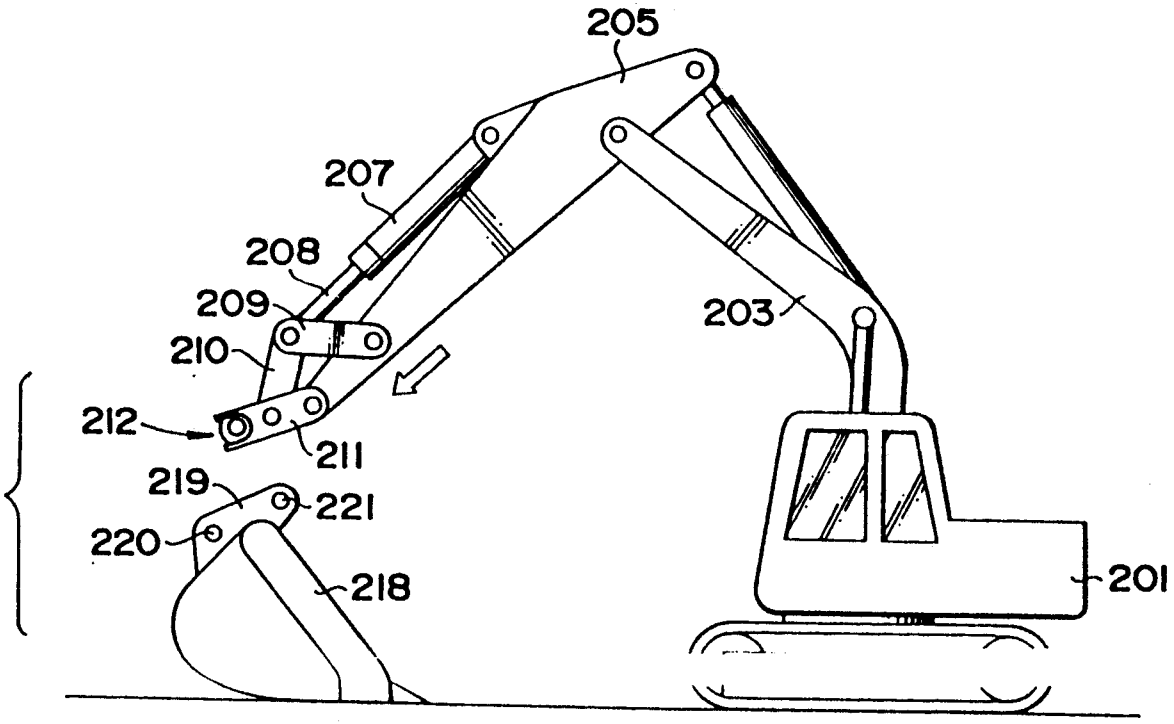
FIG. 16 is a view showing the tip end of the arm approaching the bucket.

Procedures for mounting the bucket 218 on the tip end of the arm 205 are illustrated in FIGS. 15, 16, 17 and 18. In the procedures, as illustrated in FIG. 16, the bucket 218 is at first placed on the ground and the operator of the excavator sits on the operator's seat of the chassis 201 and operates the boom 203 and the arm 205 so that the operator alone can mount the bucket 218 on the arm 205.

FIG. 16 is a view showing the state where the accessory for construction work (the bucket 218 in this case) is not attached to the tip end of the arm 205 and the operation to mount the bucket 218 on the tip end of the arm 205 starts.

Before starting the mounting operation, the bucket cylinder 207 is operated to extend the cylinder rod 208 at its maximum so that the retaining links 211 are inclined forward as far as possible to the front portion thereof. In this state, the retaining grooves 212 confront the bucket 218. At this state, when the hydraulic cylinders 204 and 206 are cooperatively operated, both the boom 203 and the arm 205 are vertically swung to thereby permit the tip end of the arm 205 to approach the attached bodies 219 of the bucket 218. Accordingly, the pair of retaining links 211 can be inserted into the space on the attached bodies 219 as illustrated in FIG. 16 As illustrated in FIGS. 12 and 13, the interval between the inner walls of the attached bodies 219 is set to be A and the interval between the outer surfaces of the retaining links 211 is also set to be A so that the retaining links 211 can be inserted into the space on the attached bodies 219 (refer to FIG. 15). As the boom 203 and the arm 205 are further swung, the retaining rings 231 are permitted to conform to the retaining grooves 212 and retaining rings 231 are inserted into the retaining grooves 212 since the inner diameters of the bearing plates 213 are set to be C and the outer diameters of the retaining rings 231 are set to be C.

Figure 17:
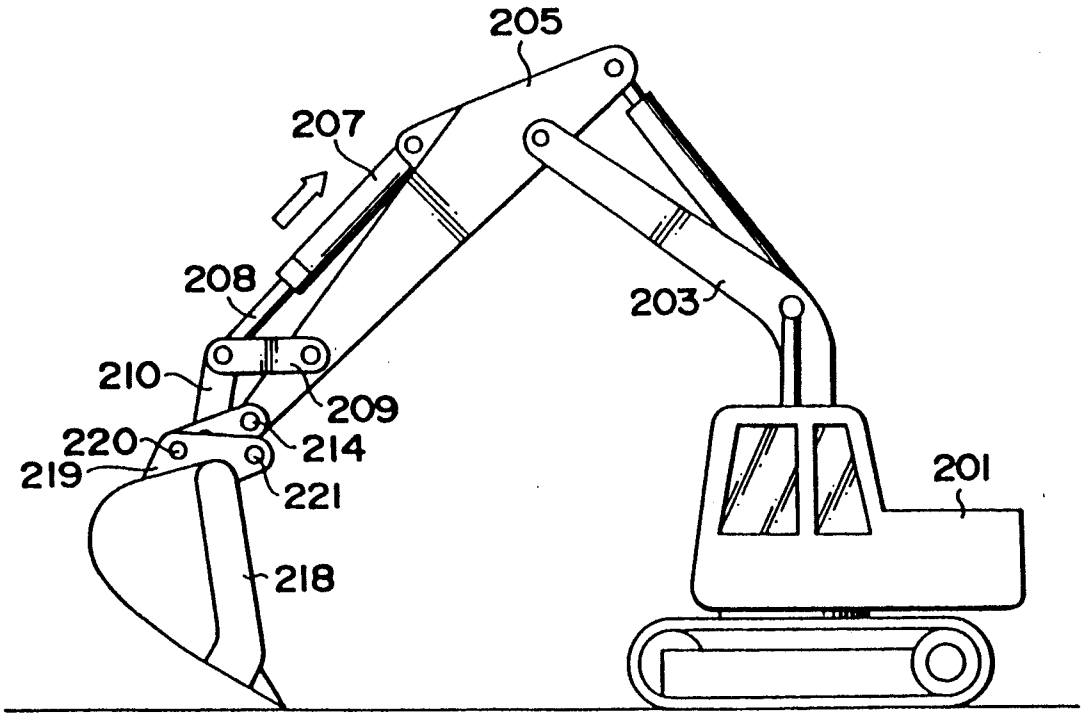
FIG. 17 is a view showing the bucket connected to the arm by one connecting pin.

In such a manner, the bucket 218 is hooked by the tip end of the arm 205 through the retaining grooves 231 and the bearing plates 213. In this state, if the boom 203 and the arm 205 are operated to permit the retaining rings 231 to be brought into contact with the innermost portions of the bearing plates 213, the axial line of the pin holes 220 conform to that of the pin holes 228. This is because the axial core of the semicircular arc of the bearing plates 213 conform to the axial core of the retaining grooves 231. If the axial core of the pin holes 220 conform to that of the pin holes 228, the connecting pin 215 can be inserted into the pin holes 220 from one side surface of one of the attached bodies 219. Accordingly, the connecting links 210 and the retaining links 211 are connected to the attached bodies 219 by the connecting pin 215. FIG. 17 is a view showing the state where the boom 203 and the arm 205 are slightly swung upward to thereby lift the bucket 218 after the connecting pin 215 is inserted to thereby connect the retaining links 211 to the attached bodies 219.

Figure 18:
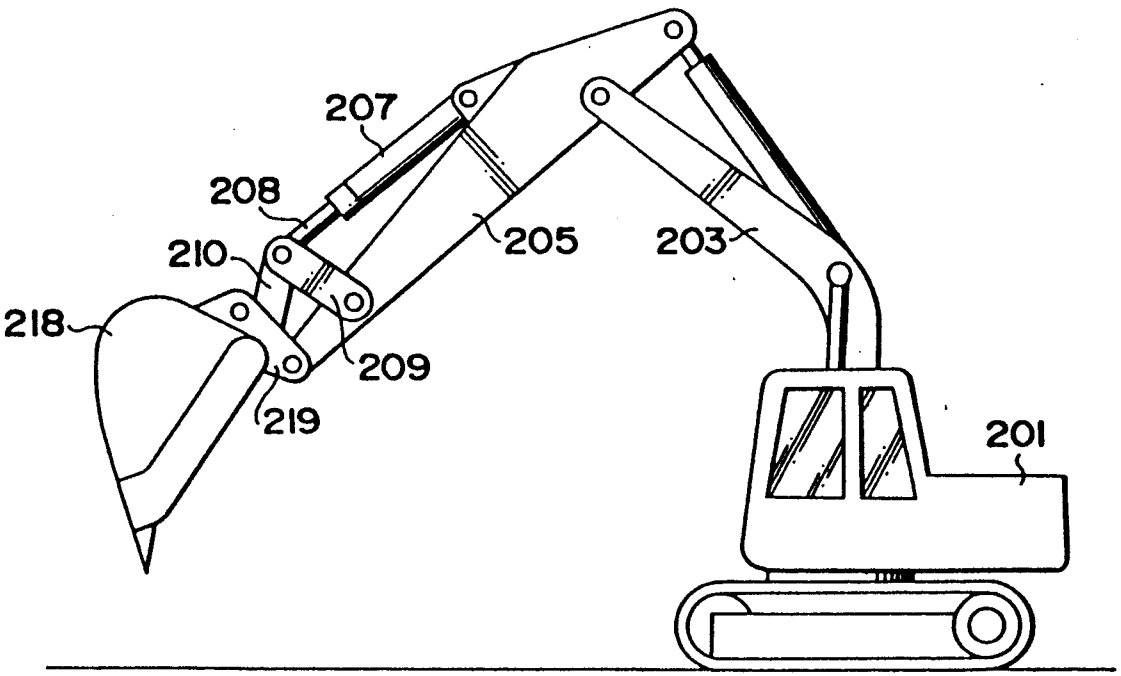
FIG. 18 is a view showing the bucket connected to the arm by two connecting pins.

After the bucket 218 is lifted by inserting the connecting pin into the pin holes 220 and 228, the bucket cylinder 207 is operated, as illustrated in FIG. 18, to contract the cylinder rod 208 thereof so that the rising links 209 are turned about the pin 226, and then the connecting links 210 pull the operating links 211 so that the retaining links 211 are turned about the shaft supporter 235. The bucket 218 is pulled upward as the retaining links 211 are turned. The bucket 218 is turned counterclockwise by its own weight relative to the operating links 211, as illustrated in FIG. 18, and the attached bodies 219 approach the tip end of the arm 205. When the attached bodies 219 and the arm 205 approach each other, both the pin holes 214 and 221 approach each other so that both the axial lines of the pin holes 214 and 221 conform to each other. Since the interval between the axial lines of the pin holes 214 and 228 to the interval between those of the pin holes 220 and 221, if both the pin holes 220 and 228 are connected by the connecting pin 215, the axial lines of the pin holes 214 and 221 will conform to each other. Thereafter, the connecting pin 216 is inserted into the pin holes 214 and 221 from the side surface of one of the attached bodies 219 so that the bucket 218 is connected to the tip end of the arm 205 by the connecting pin 216.

With a series of procedures set forth above according to the second embodiment, the bucket 218 can be mounted on the tip end of the arm 205. When the bucket 218 is disconnected from the tip end of the arm 205, the connecting pins 215 and 216 are in turn pulled out from the pin holes in the order of the procedures as illustrated in FIG. 18, FIG. 17 and FIG. 16.

Third Embodiment (FIGS. 19 to 26)

An accessory detachable mechanism of a construction machine according to a third embodiment will be described with reference to FIGS. 19 to 26.

The construction machine according to the third embodiment is the same as that of the second embodiment, hence the numerals common to those of the second embodiment are denoted by the same numerals and the explanation thereof is omitted. More specifically, only the accessory detachable mechanism provided at the tip end of the arm 205 is modified.

Figure 19:
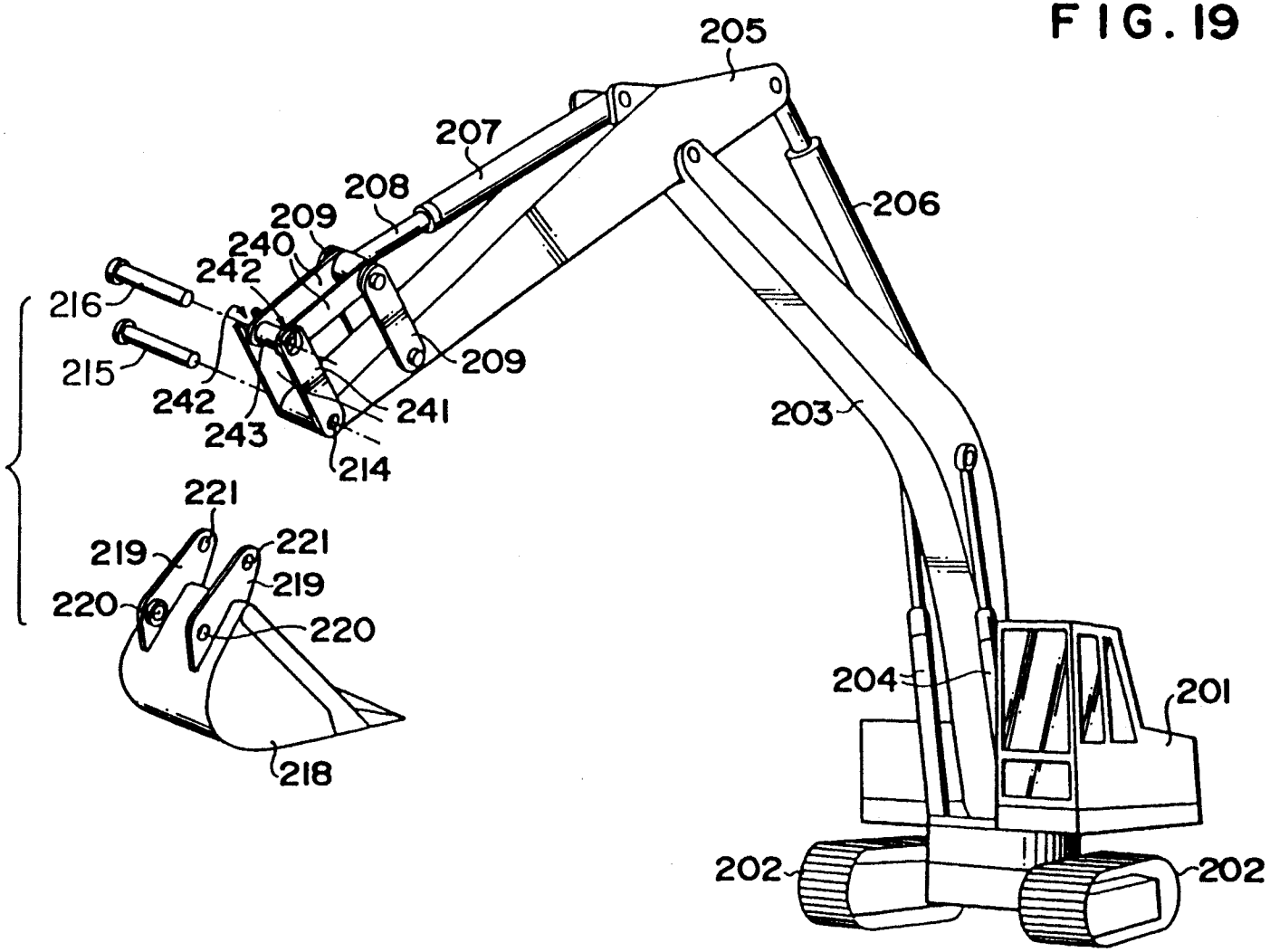
FIG. 19 is a perspective view showing the mechanism for connecting a bucket to an arm of an excavator according to a third embodiment of the present invention.

In FIG. 19, connecting links 240 are connected to the tip end of the cylinder rod 208 in parallel with each other while a pair of retaining links 241 are pivotally connected to the tip end of the arm 205. The connecting links 240 and the retaining links 241 are pivotally connected to one another at the tip ends thereof. Accordingly, the arm 205, the rising links 209, the connecting links 240 and the retaining links 241 form a substantially parallelogram link mechanism. Substantially U-shaped retaining grooves 242 are formed at the upper ends of the retaining links 241 and open upward. A pipe-shaped sliding body 243 has both ends which are large in the diameters thereof and are positioned adjacent to the U-shaped retaining groove 242. The sliding body 243 has a pin hole 244 which is open in the central portion thereof in which the axial core of the pin hole 244 conforms to the axial cores of the innermost semicircular arcs of the retaining grooves 242. The sliding body 243 is inserted into holes provided at the tip end of the connecting links 240 at the periphery thereof whereby the connecting links 240 can be slidably connected to the retaining links 241 by the sliding body 243. The pin holes 214 are pierced in the central axis between the tip end of the arm 205 and the retaining links 241 in which the retaining links 241 turn about the central axis. The connecting pin 216 is inserted into the pin holes 214 while the connecting pin 215 is inserted into the pin hole 244 defined in the sliding body 243.

Figure 20:
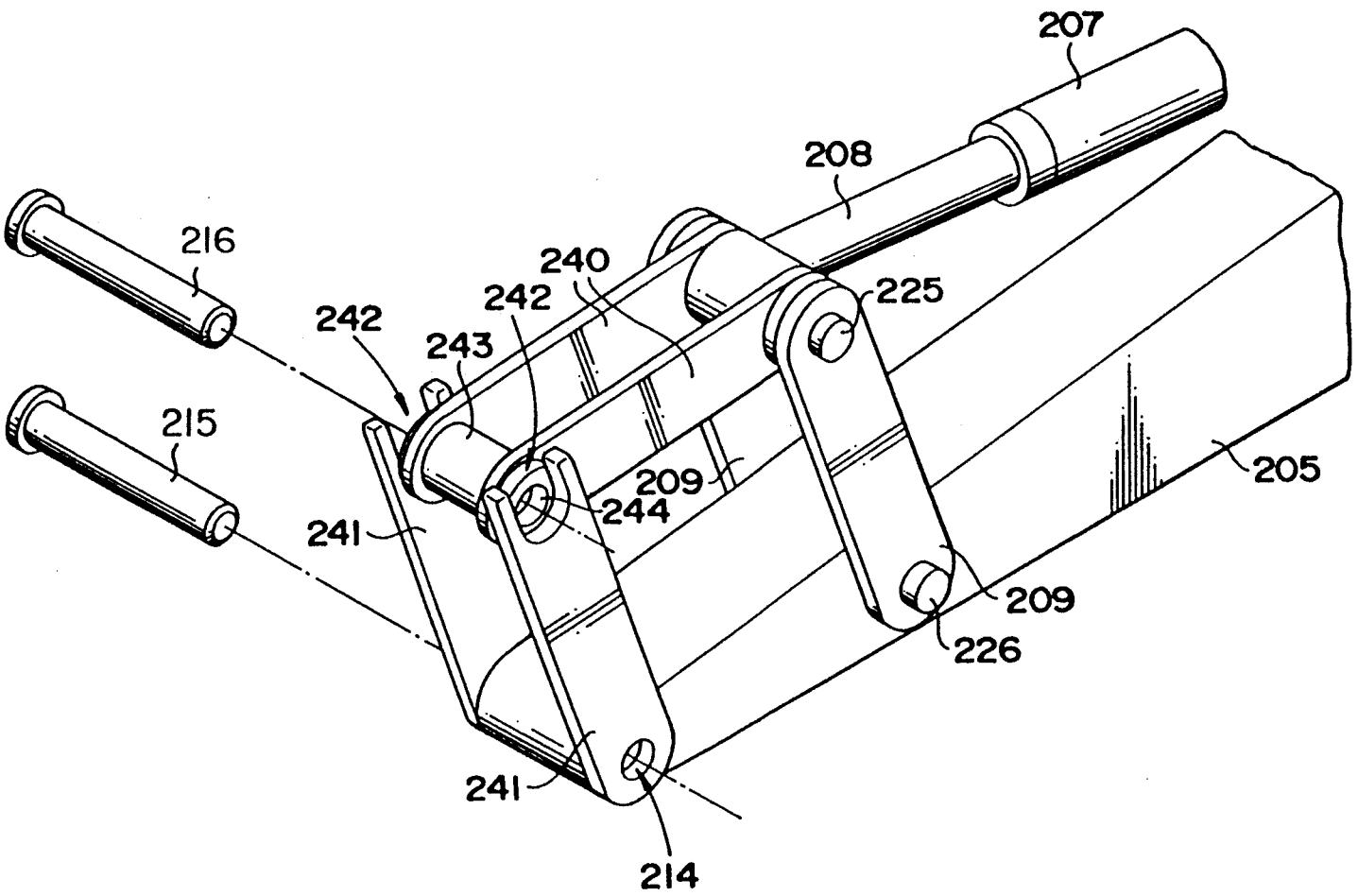
FIG. 20 is an enlarged perspective view showing the arrangement of each component adjacent to the tip end of the arm.

FIG. 20 is an enlarged view showing an arrangement adjacent to the tip end of the arm 205 according to this embodiment. The U-shaped retaining grooves 242 are defined at the upper ends of the retaining links 241 and the sliding body 243 is fixed to the upper ends of the retaining links 241 by welding or similar means of conventional attachment. The sliding body 243 has two flange-shaped sides and the flange-shaped sides are respectively brought into contact with and fixed to the inner surfaces of the retaining links 241. The pin hole 244 is defined at the center of the sliding body 243 which is pierced to leftward and rightward in which the axial line of the pin hole 244 conforms to the axial line of the curved surfaces of the innermost semicircular arcs of the retaining groove 242.

Figure 21:
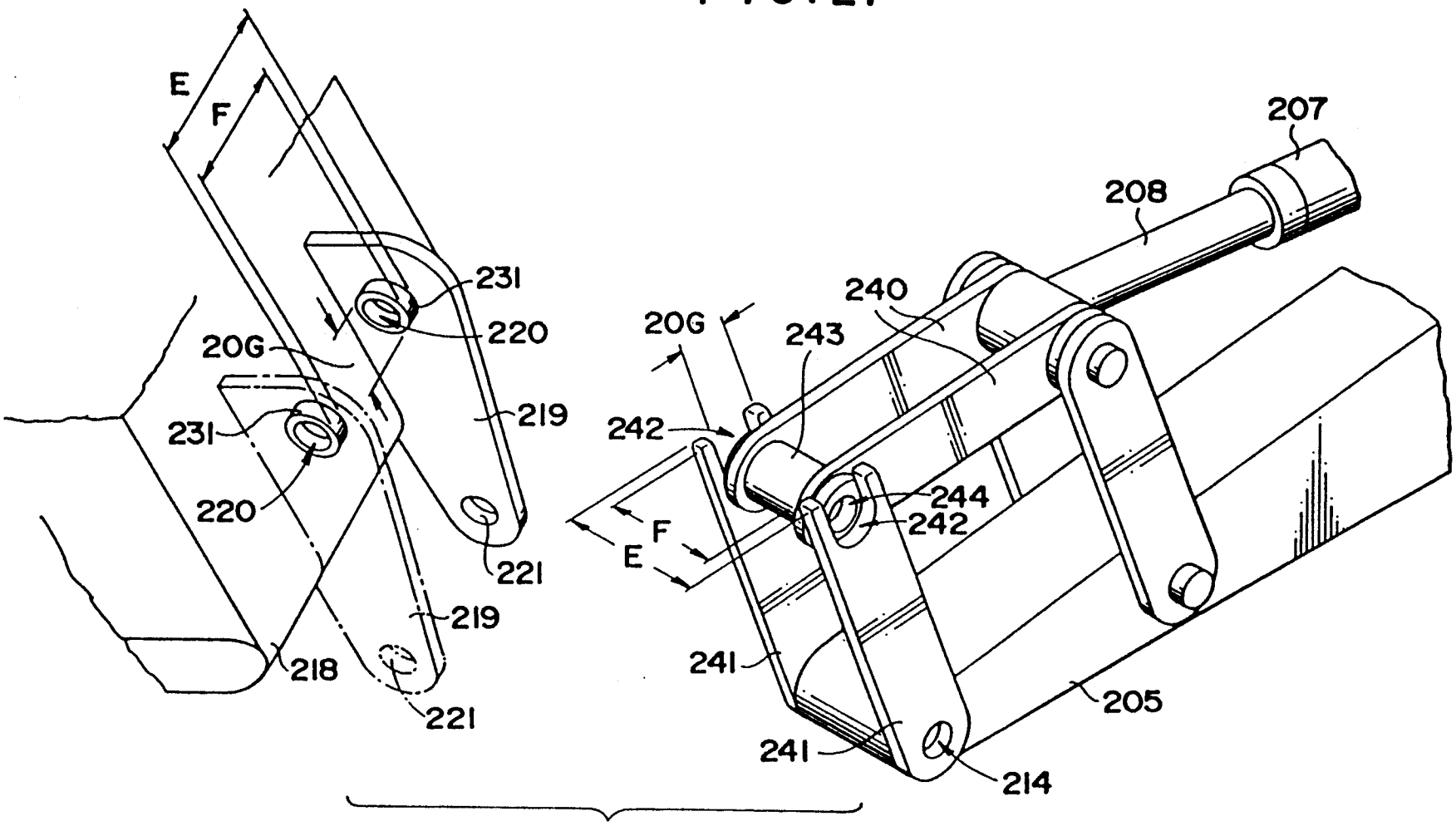
FIG. 21 is an enlarged perspective view showing a mechanism adjacent to the tip end of the arm and a mechanism of the bucket.

FIG. 21 is an enlarged perspective view showing the relation of the lengths of the attached bodies 219 fixed to the bucket 218, the retaining links 241, the retaining grooves 242 and each part of the retaining links 241. An inner interval between the attached bodies 219 fixed to the bucket 218 is set to be E while an inner interval between the retaining rings 231 fixed to the inner walls of the attached bodies 219 is set to be F and the outer diameters of the retaining rings 231 are set to be G. The interval between the retaining links 241, which are connected to the tip end of the arm 205, are set to be E while the interval between the inner walls of the retaining links 241 are set to be F and the widths of the retaining grooves 242, which are defined at the upper ends of the retaining links 241, are set to be G.

Figure 22:
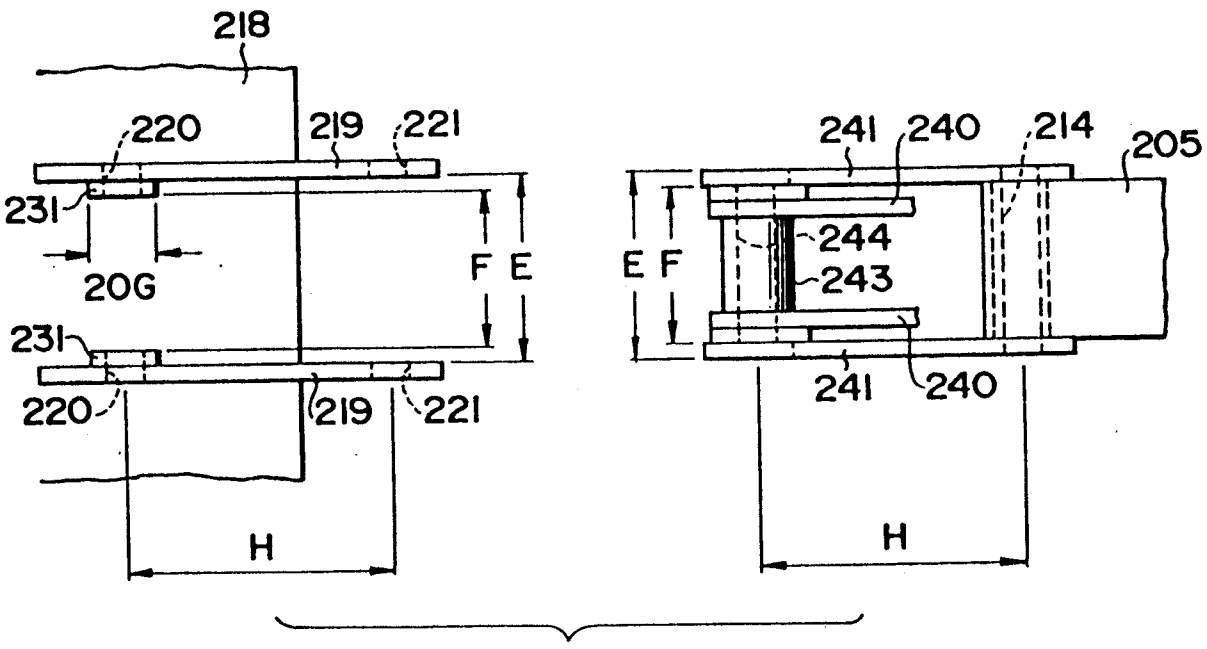
FIG. 22 is a plan view showing the relation between the portion adjacent to the arm and the component of the bucket.
Figure 23:
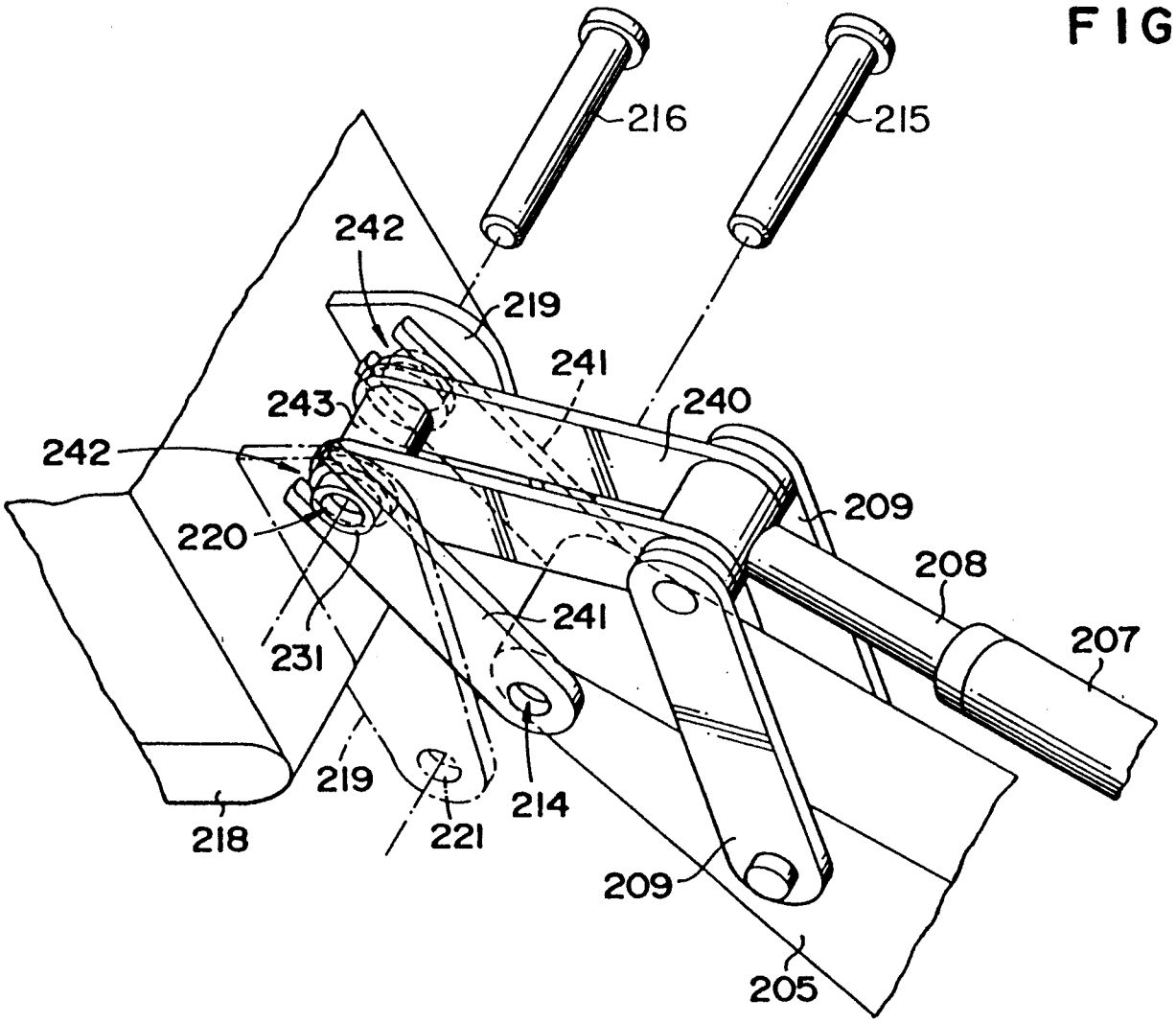
FIG. 23 is a perspective view showing one positional relation between the arm and the bucket.

FIG. 22 is a plan view showing the relation between the intervals or dimensions E, F and G of the components as illustrated in FIG. 21. Evident from this figure, the retaining links 241 can be inserted into the space of the attached bodies 219 while the retaining rings 231 can be inserted into the retaining grooves 242. The interval between the axes of the pin hole 214 and the pin hole 244 is set to be H while the interval between the axes of the pin holes 220 and the pin holes 221 is set to be H. Accordingly, when the retaining rings 231 are retained by the innermost portions of the retaining grooves 242, the axial line of the pin holes 220 conforms to that of the pin holes 244 and at the same time the axial line of the pin holes 221 conforms to that of the pin holes 214.

The procedure to attach the bucket 218 to the tip end of the arm 205 is explained with reference to FIGS. 23, 24, 25 and 26. This procedure flows in the first step where the bucket 218 is placed on the ground and detached from the arm 205 as illustrated in FIG. 15 and in the last step where the bucket 218 is connected to the arm 205 as illustrated in FIG. 26.

Figure 24:
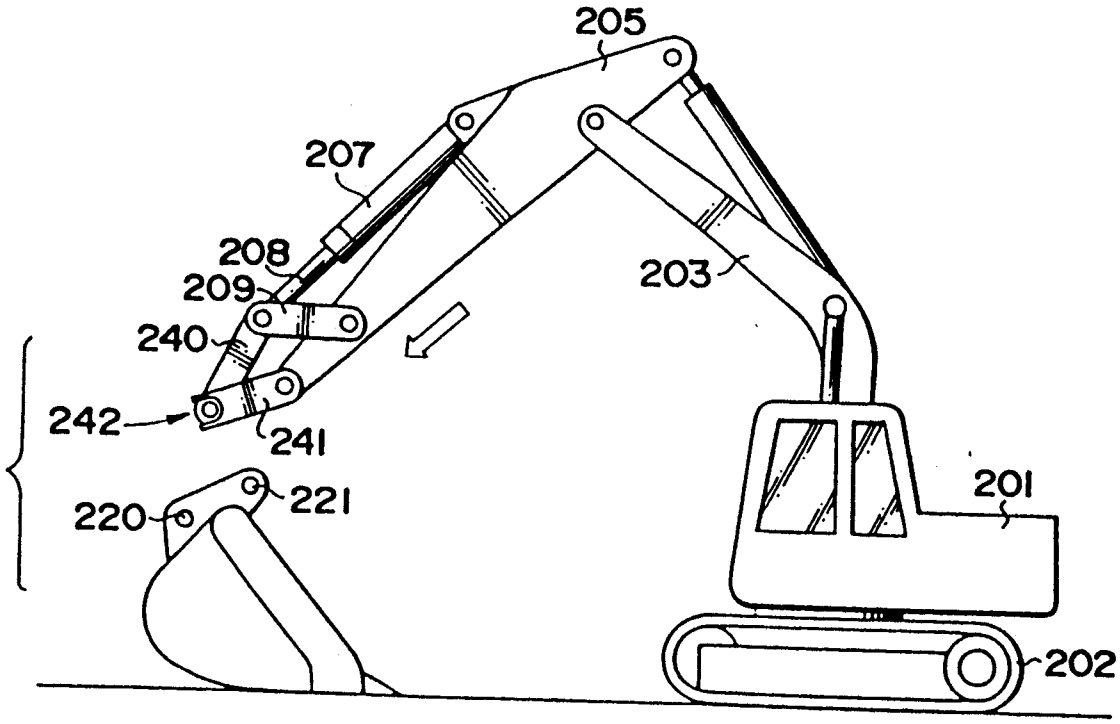
FIG. 24 is a view showing the tip end of the arm approaching the bucket.

In the state as illustrated in FIG. 24, the bucket cylinder 207 is first operated to extend the cylinder rod 208 at its maximum while the retaining links 241 are inclined forward as much as possible. Thereafter, two retaining links 241 are directed toward the attached bodies 219 causing the tip end of the retaining links 241 to be directed toward the retaining rings 231. The retaining rings 231 are fitted into the U-shaped retaining grooves 242 and are pushed into the innermost portions of the retaining grooves 242 by swinging the boom 203 and the arm 205. Consequently, the axial lines of the innermost semicircular arcs of the retaining grooves 242 conform to the axial line of the pin holes 220 so that the connecting pin 215 can be inserted from one side surface of one of the attached bodies 219 into the pin hole 244, whereby the retaining rings 241 and the bucket 218 can be connected by the pin 215.

Figure 25:
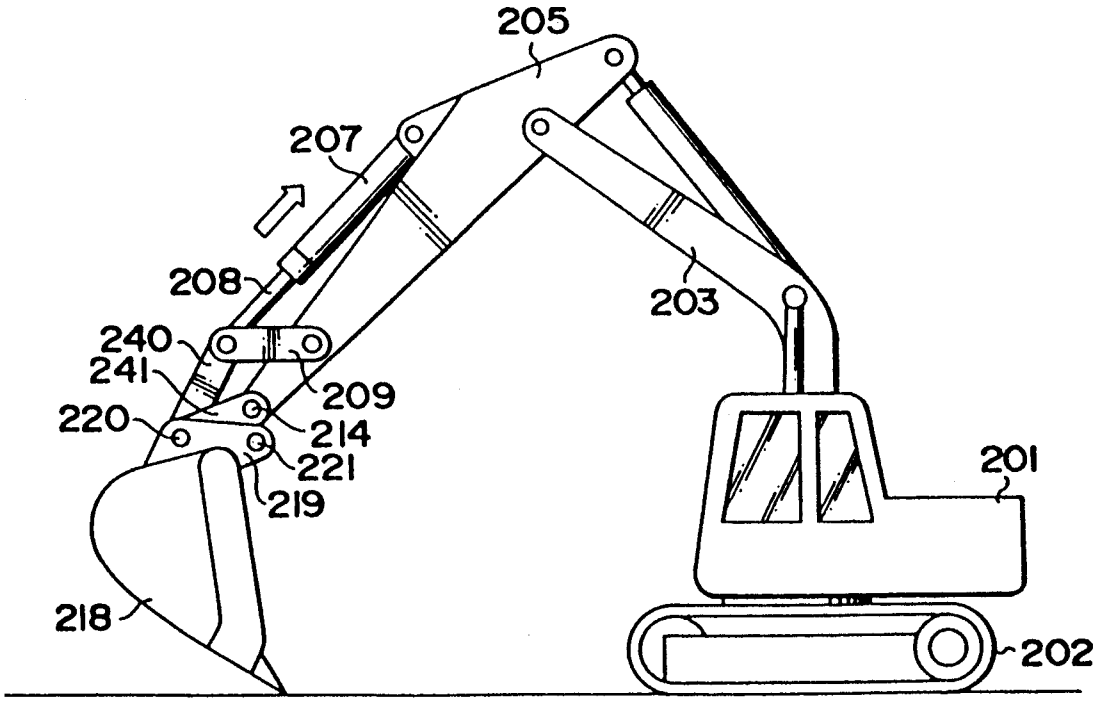
FIG. 25 is a view showing the bucket connected to the arm by one connecting pin.
Figure 26:
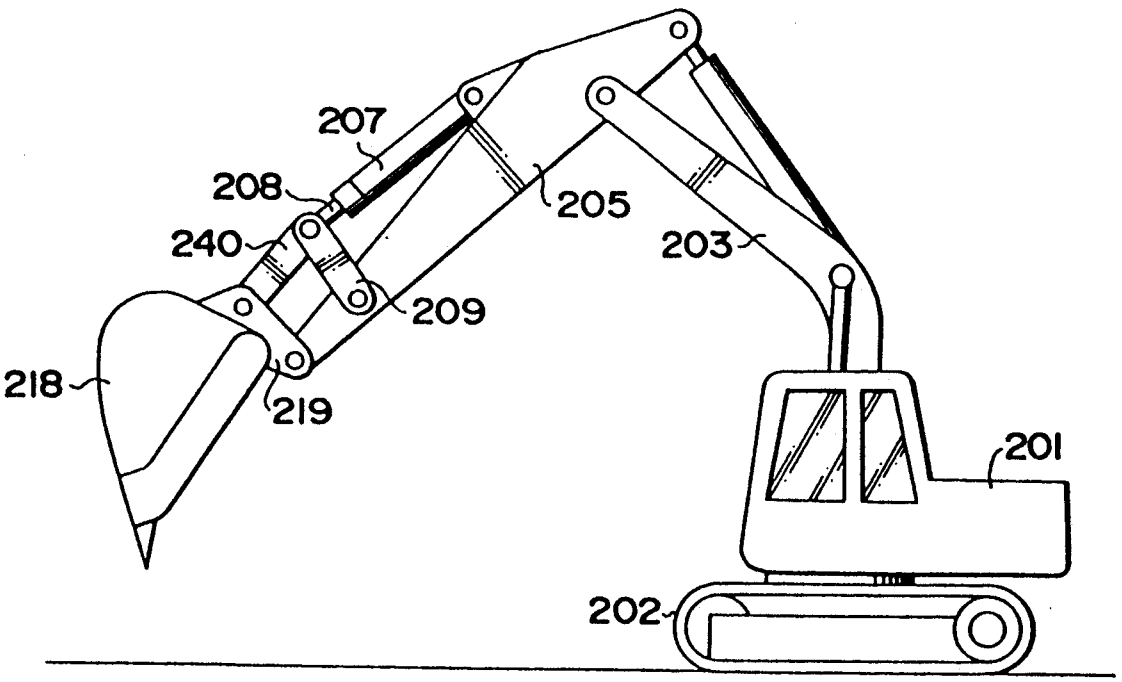
FIG. 26 is a view showing the bucket connected to the arm by two connecting pins.

As illustrated in FIG. 25, the boom 203 and the arm 205 are operated to swing upward and thereby lifting up the bucket 218 from the ground. The lifted bucket 218 is shown in FIG. 25. At this state, the bucket 218 is hooked by the retaining links 241 by the connecting pin 215, hence the bucket 218 hangs down by its own weight. At the state illustrated in FIG. 25, the bucket cylinder 207 is operated to contract the cylinder rod 208 so that the retaining links 241 turn clockwise. At the same time, the attached bodies 219 are pulled up, and the bucket 218 is directed downward about the connecting pin 215 due to its own gravity so that the bucket 218 is drawn relative to the tip end of the arm 205 As a result, the pin holes 221 defined in the attached bodies 219 approach the pin holes 214 of the arm 205 and cause the pin holes 214 to conform to the pin holes 221 as illustrated in FIG. 26.

As explained with reference to FIG. 22, the interval H between the axial lines of the pin holes 220 and 221 is the same as those of the interval H between the axial lines of the pin holes 214 and 244, when the cylinder rod 208 is contracted, and the bucket 218 and the arm 205 relatively approach each other. As a result, the pin holes 221 approach the pin holes 214 and cause the axial core of the pin holes 214 to conform to that of the pin holes 221. At this state, the connecting pin 216 is inserted into the holes from one side surface of the attached bodies 219 so that the arm 205 and the attached bodies 219 are connected by the pin 216. In this way, the bucket 218 can be attached to the tip end of the arm in the procedures as illustrated in the order of FIGS. 24, 25 and 26. In the second embodiment, since the connecting links 240 are connected to the portion adjacent to the tip end of the arm 205, the point where the bucket 218 and the connecting links 240 operate conforms to the axial line of the pin holes 215 so that the stress from the bucket cylinder 207 can be transmitted directly to the bucket 218.

With the arrangements of the second and third embodiments of the present invention, it is possible to position the two pin holes defined on the tip end of the arm to the two pin holes defined on the accessory with ease and possible to connect the arm to the accessory by the two connecting pins, although the structure thereof is very simple. Both the arm and the accessory can be connected strongly to each other by the pins and can be turned smoothly. Accordingly, deformation of the components is not likely even if a strong external force is applied to the accessory. Furthermore, the structure of the mechanism is very simplified compared with the conventional mechanism and the number of parts is reduced.

Fourth Embodiment (FIGS. 27 to 35)

An accessory detachable mechanism of a construction machine according to a fourth embodiment will be described with reference to FIGS. 27 to 35.

The construction machine according to the fourth embodiment is similar to that of the first to third embodiments, hence the explanation thereof is omitted. Described hereinafter is mainly the detachable mechanism and the accessory.

A pair of connecting links 310 are pivotally connected to the tip end of a cylinder rod 308 in parallel with each other and directly forward of the arm 305. A pair of retaining links 311 are disposed in parallel with each other between the tip ends of the connecting links 310 and the tip end of the arm 305 and are swingably connected to each other. A substantially parallelogram link mechanism is formed by the arm 305, rising links 309, the connecting links 310 and retaining links 311. Retaining pawls 312, which are directed upward, protrude from the upper end front portion of the retaining links 311. Substantially U-shaped retaining grooves 313, which are open upward, are formed by the side surfaces of the retaining links 311 and retaining pawls 312. Pin holes 314, which are pierced rightward and leftward, open in the rotary center about which the retaining links 311 and the arm 305 turn. A connecting pin 316 inserts into pin holes 314 while a connecting pin 317 inserts into the pin hole 315.

Figure 27:
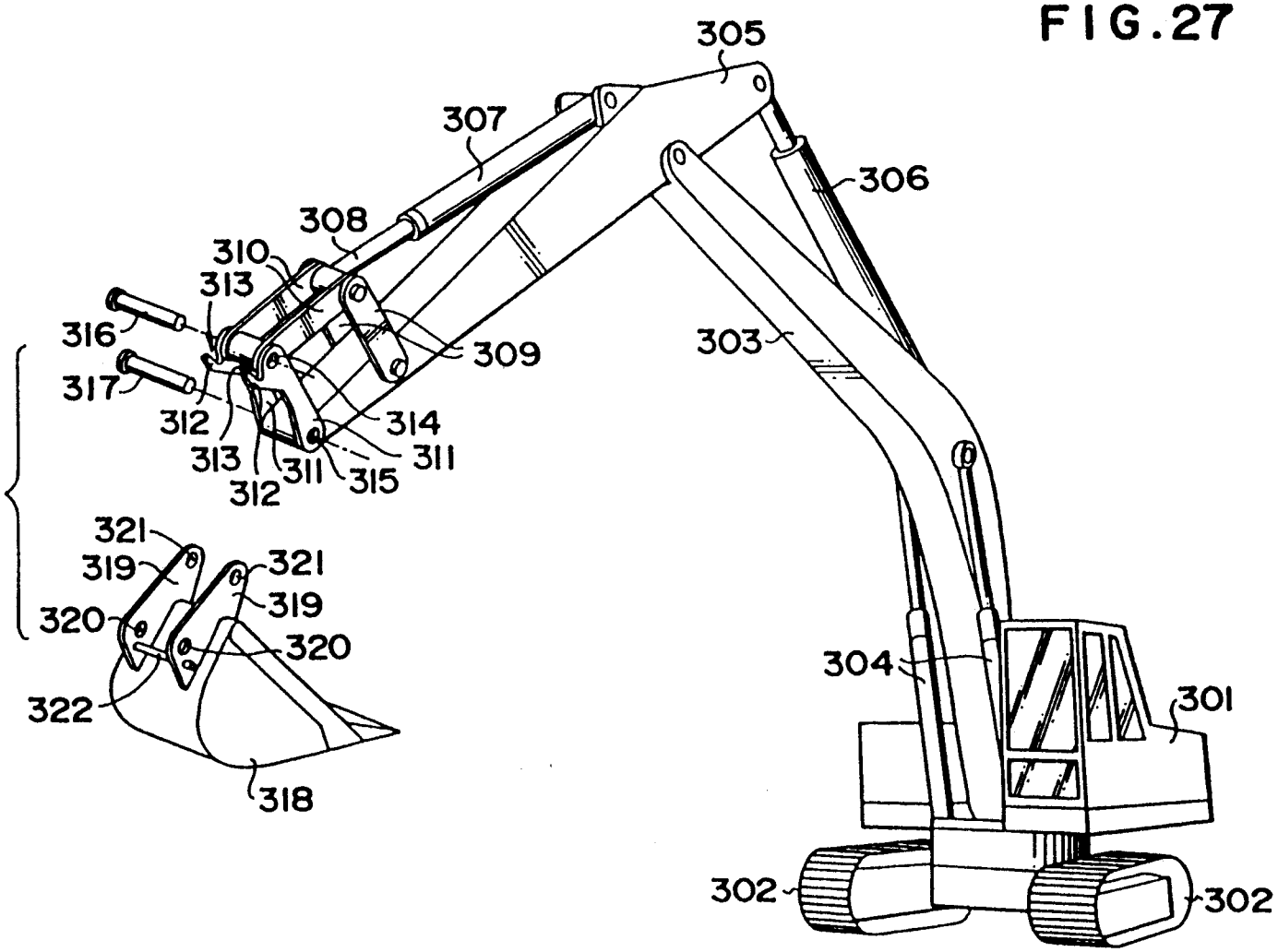
FIG. 27 is a perspective view showing the mechanism for connecting a bucket to an arm of an excavator according to a fourth embodiment of the present invention.

In FIG. 27, a bucket 318 has a pair of flat-shaped attached bodies 319 which is fixed to an outer periphery of the bucket 318 in parallel with each other. The attached bodies 319 have a pair of pin holes 320 and 321 at the front and rear portions thereof which total four. An axial line of the pair of pin holes 320 is arranged to be parallel with that of the pair of pin holes 321. The interval between the axial line of the pair of pin holes 320 and that of the pair of pin holes 321 conforms to an interval between the pin holes 314 and 315 of the operating links 311. A retaining pin 322 is fixed to the pair of attached bodies 319 and positioned closer to the body of the bucket 318 than the pin holes 320 and extends between the pair of attached bodies 319. The retaining pin 322 is rod shaped and has an outer diameter which is slightly less than the width of the retaining grooves 313. The axial line of the retaining pin 322 is arranged to be parallel with the axial line of a pair of the pin holes 320.

Figure 28:
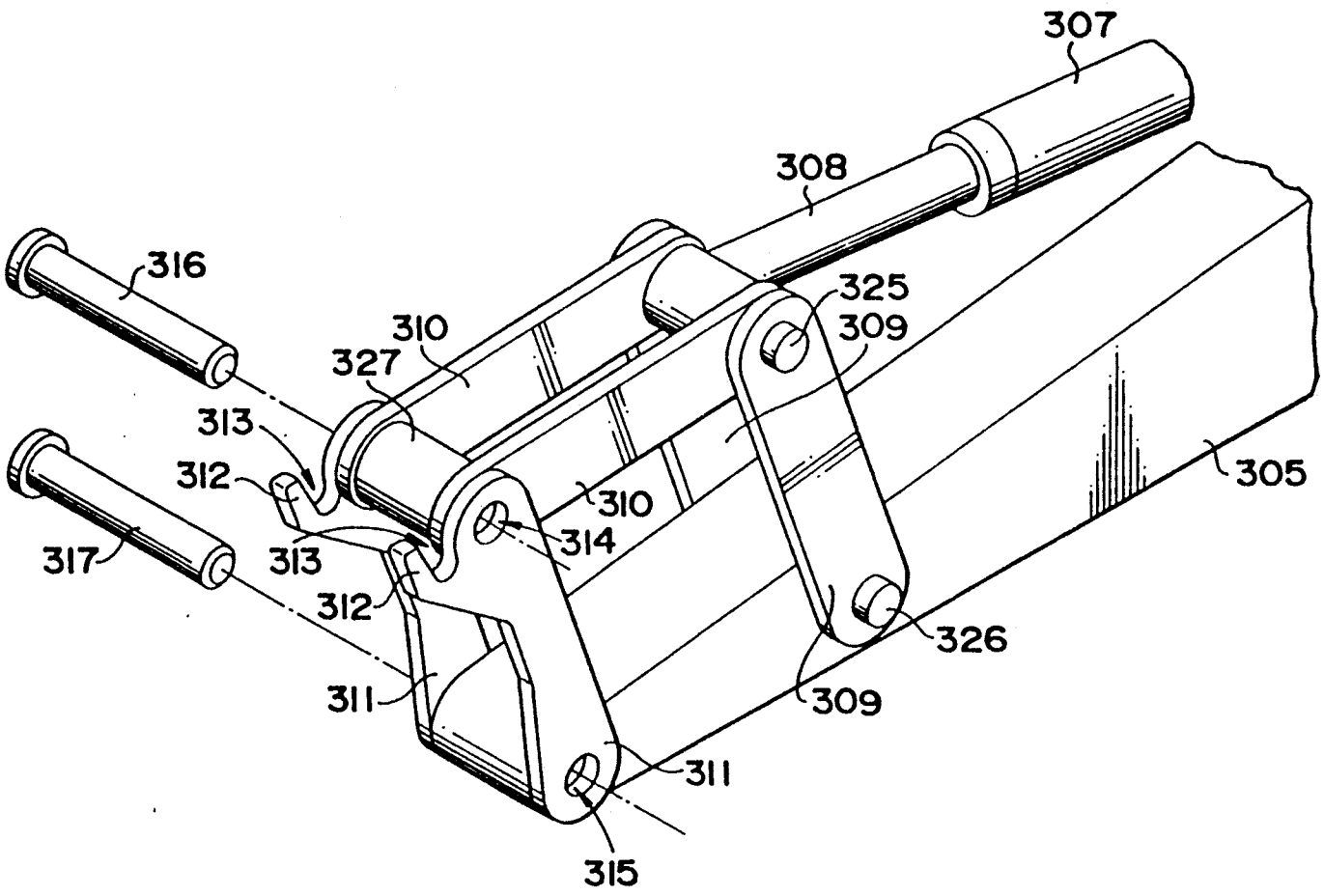
FIG. 28 is an enlarged perspective view showing an arrangement of each component adjacent to the tip end of the arm.

FIG. 28 is an enlarged view showing the accessory detachable mechanism which is positioned adjacent to the tip end of the arm 305. A pin 325 is inserted into the tip end of the cylinder rod 308 and the connecting links 310 are pivotally connected by the pin 325 to the right and left sides of the cylinder rod 308. The rising links 309 are pivotally inserted into the pin 325 at the right and left sides of the connecting links 310. The rising links 309 extend downward and have lower ends which are pivotally connected to the portion adjacent to the tip end of the arm 305 by a pin 326. The retaining links 311 are disposed at right and left sides of the tip end of the arm 305 and extend upward. The upper ends of the retaining links 311 are pivotally connected to the tip ends of the connecting links 310 while a collar 327 is interposed between the tip ends of the pair of connecting links 310. A pair of substantially L-shaped retaining pawls 312 protrude from the front middle portions of the retaining links 311 (left side in FIG. 28) and are directed upward. The retaining pawls 312 conform to the upper ends of the retaining links 311. Since the retaining pawls 312 protrude in front of the retaining links 311, the retaining grooves 313 are defined between the retaining pawls 312 and the retaining links 311. The retaining pawls may be shaped so as to extend from the curves of the semicircular arcs provided at the upper ends of the retaining links 311.

Figure 29:
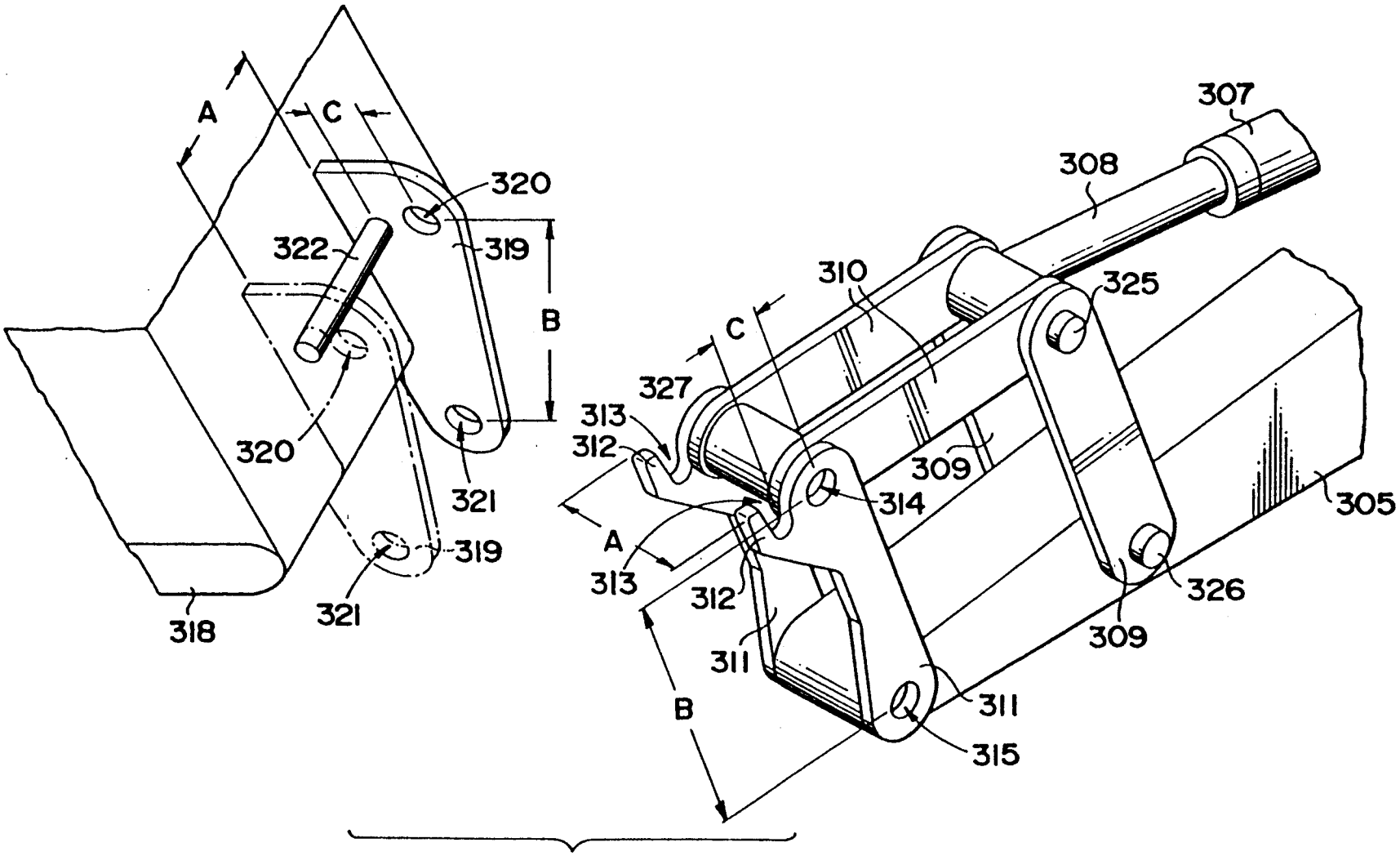
FIG. 29 is an enlarged perspective view showing a mechanism adjacent to the tip end of the arm and a mechanism of the bucket.

FIG. 29 is a perspective view showing the relation of the lengths between the attached bodies 319 and each component attached to the arm 305. The pair of flat-shaped attached bodies 319 are fixed to a rear surface of the bucket 318 in a given interval wherein an internal interval of the attached bodies 319 is set to be A. An interval between the axial lines of the pin holes 320 and 321 is set to be B while an interval between the axial core of the pin holes 320 and the axial core of the retaining pin 322 is set to C. An outer interval between the pair of retaining links 311 is set to be A while an interval between the axial cores of the pin holes 314 and 315 of the retaining links 311 is set to be B. An interval between the axial cores of the pin holes 314 and the centers of the retaining grooves 313 is set to be C.

Figure 30:
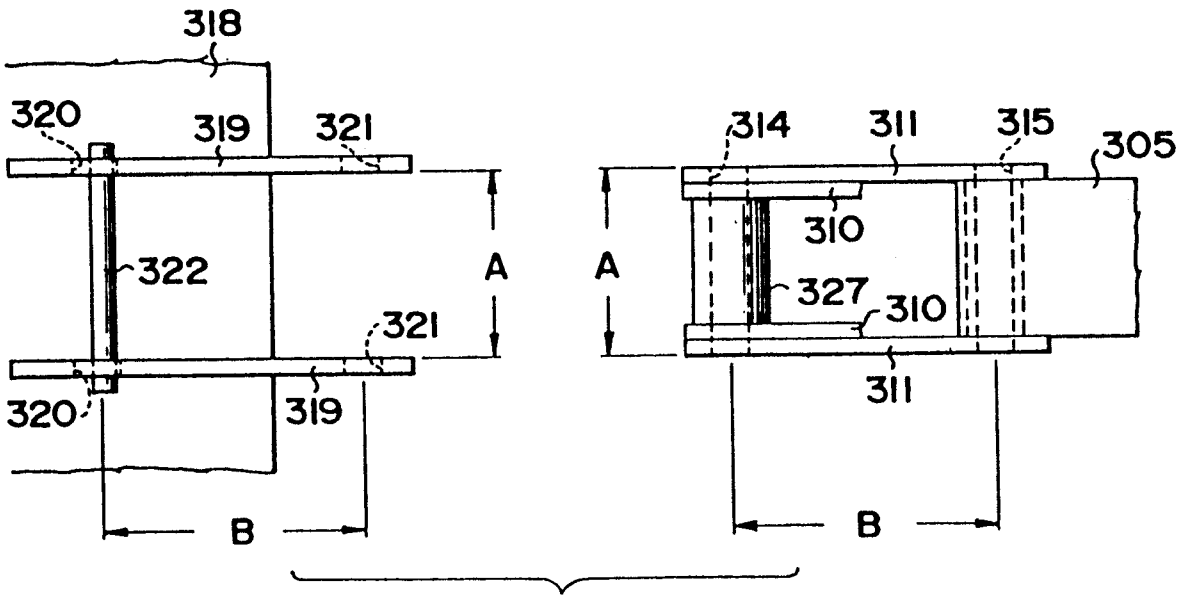
FIG. 30 is a plan view showing one relation between the portion adjacent to the arm and a component of the bucket.

FIG. 30 is a plan view showing the relation between the intervals A and B between the components as illustrated in FIG. 29. As evident from this figure, the retaining links 311 can be inserted into the space between the attached bodies 319.

Figure 31:
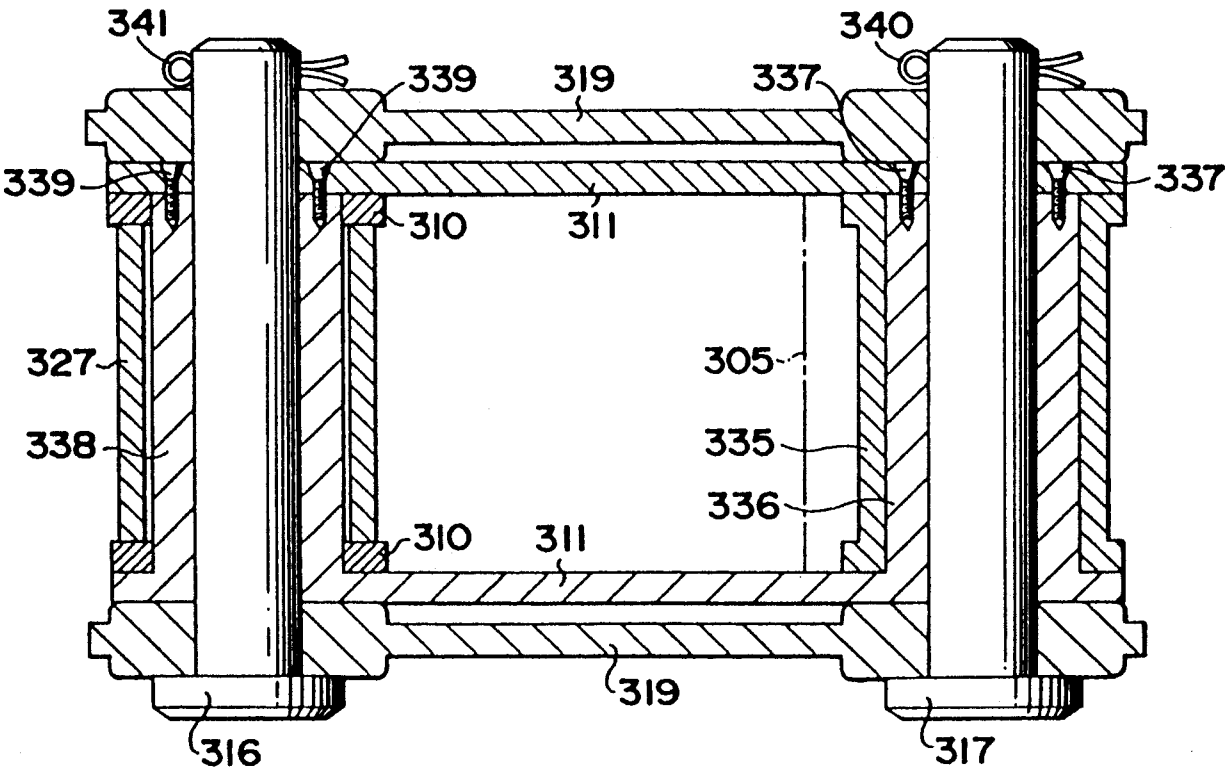
FIG. 31 is a cross-sectional view showing the bucket attached to the tip end of the arm.

FIG. 31 is a cross-sectional view showing the state where the retaining links 311 are fitted into the attached bodies 319 and both the retaining links 311 and the attached bodies 319 are connected to one another by the connecting pins 316 and 317. At this state, the connecting pin 316 is inserted into the pin holes 314 and 320, and the connecting pin 317 is inserted into the pin holes 315 and 321 so that the bucket 318 is connected to the tip end of the arm 305. A shaft supporter 335 is fixed to the tip end of the arm 305. The shaft supporter 335 is pierced rightward and leftward to form an opening hole and has flange-shaped both sides. A cylindrical bearing 336 is fixed to the lower surface of one of the retaining links 311 and positioned coaxially with the pin holes 315. The bearing 336 is rotatably inserted into the shaft supporter 335 and has a tip end which extends to and is brought into contact with side surfaces of the retaining link 311. One retaining link 311 and bearing 336 are fixed to each other by a screw 337. A cylindrical shaft supporter 338 is fixed to the side surface of the other link 311 and is positioned coaxially with the pin holes 314 and has a tip end which is brought into contact with the side surface of the retaining link 311. The first retaining link 311 and the shaft supporter 338 are fixed to each other by a screw 339. Both the retaining links 311 can turn at the same time about the shaft supporter 335 relative to the arm 305 by the bearing 336, the shaft supporter 338, the screw 337 and the screw 339.

The axial center of the pipe-shaped bearing 336 conforms to the axial core of the pin holes 315 which open toward the retaining links 311. The axial center of the pipe-shaped bearing 338 conforms to the axial core of the pin holes 314. A connecting hole which opens to the tip ends of the connecting links 310 is rotatably inserted into the outer periphery of the shaft supporter 338. A pipe-shaped collar 327 is interposed between the two connecting links 310 which restrain both the connecting links 310 from approaching. With such an arrangement, the connecting pin 316 is inserted into the pin holes 314 and 320, and the connecting pin 317 is inserted into the pin holes 315 and 321 whereby the retaining links 311 and the attached bodies 319 are connected with one another. Split pins 340 and 341 are inserted into the tip ends of the thus inserted connecting pins 316 and 317 in the perpendicular direction relative to the axial lines thereof, whereby the connecting pins 316 and 317 are prevented from coming off.

Figure 32:
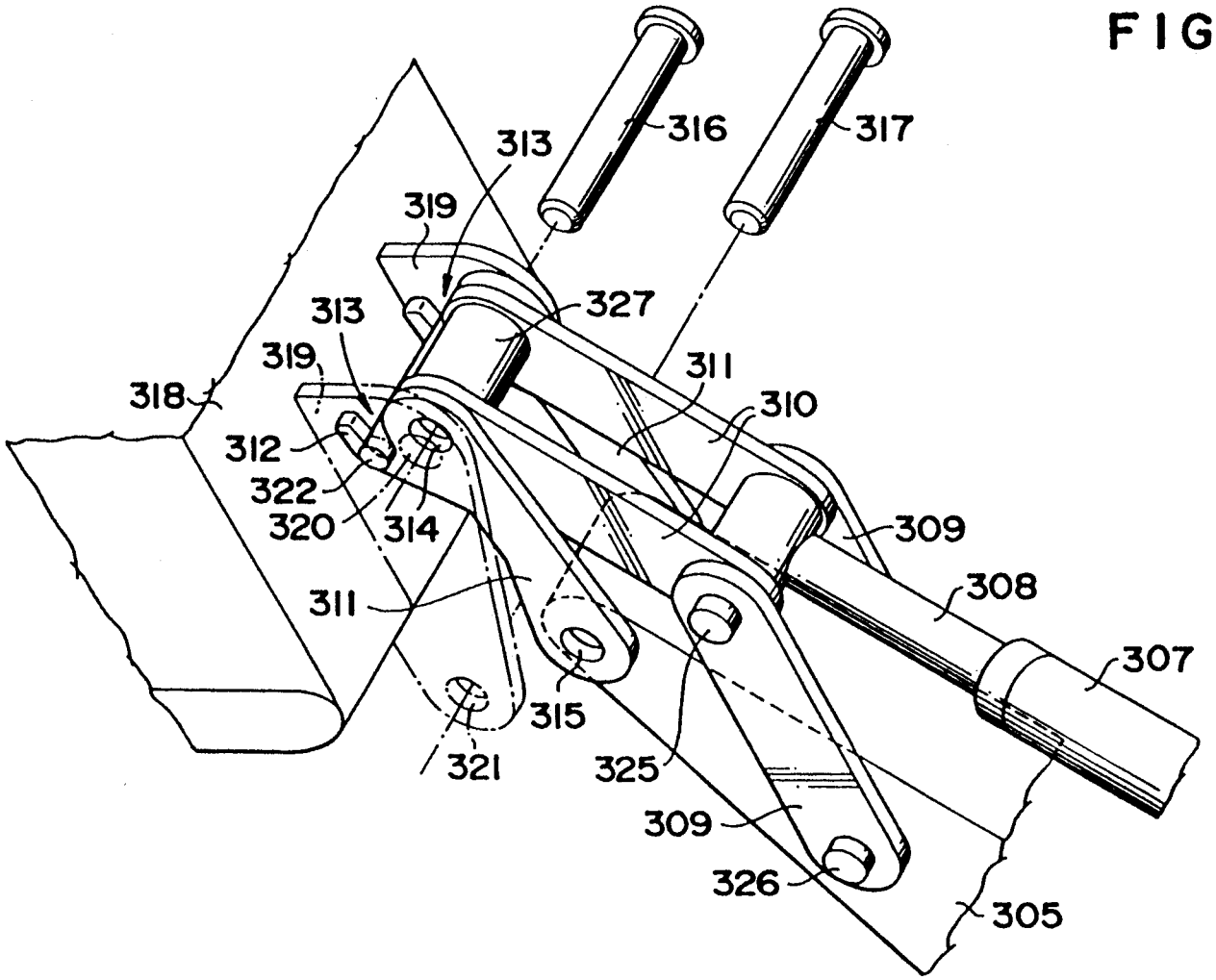
FIG. 32 is a perspective view showing a retaining pin fitted on retaining links.
Figure 33:
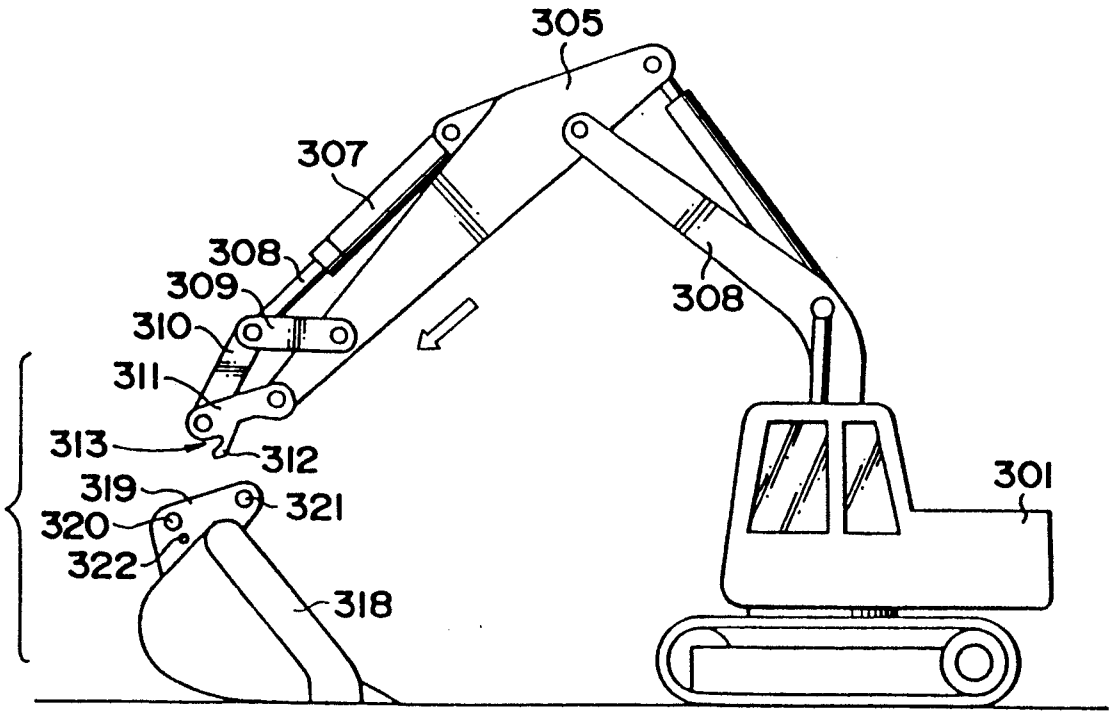
FIG. 33 is a view showing the tip end of the arm approaching the bucket.

Procedures for mounting the bucket 318 on the tip end of the arm 305 are illustrated in FIGS. 32, 33, 34 and 35. As illustrated in FIG. 33, the bucket 318 is placed on the ground and the operator of the excavator sits on the operator's seat of the chassis 301 and swings the boom 303 and the arm 305 forward and backward so that the operator alone can mount the bucket 318 on the arm 305.

FIG. 33 is a view showing the accessory for construction work (the bucket 318 in this case) about to be attached to the tip end of the arm 305. Before starting the mounting operation, the bucket cylinder 307 is operated to extend the cylinder rod 308 at its maximum so that the retaining links 311 are inclined as far as possible to the front portion thereof. By the inclination of the retaining links 311, the retaining pawls 312 are directed downward and the retaining grooves 313 are positioned at the tip end of the arm 305.

At the state where the mounting preparation is completed, both the boom 303 and the arm 305 are vertically swung to thereby permit the tip end of the arm 305 to approach the attached bodies 319. When both sides of the retaining links 311 are positioned in the space between the pair of attached bodies 319, the open ends of the retaining grooves 313 are permitted to confront with the retaining pin 322. Successively, the boom 303 and the arm 305 are operated to thereby move the retaining links 311 left aslant downward so as to push the retaining pin 322 in the retaining grooves 313. The state where the retaining pin 322 is fitted into the retaining grooves 313 is illustrated in FIG. 32. At this state, since the retaining pin 322 is fitted onto the innermost portion of the retaining grooves 313, the relative position between the retaining links 311 and the bucket 318 is determined by the retaining grooves 313 and the retaining pin 322.

Figure 34:
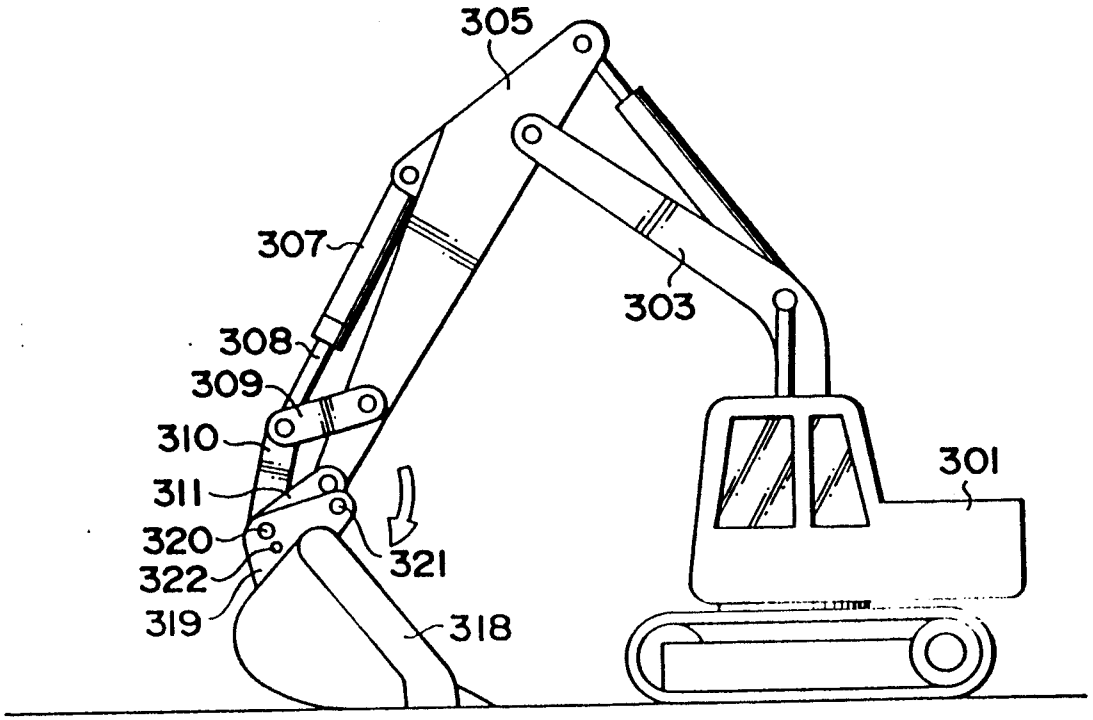
FIG. 34 is a view showing the bucket connected to the arm by one connecting pin.

In such a manner, the hydraulic cylinder 304, the hydraulic cylinder 306 and the bucket cylinder 307 are controlled in the state where the outer periphery of the retaining pin 322 contacts the innermost portions of the retaining grooves 313 so that the retaining links 311 are turned clockwise in FIG. 34 about the retaining pin 322.

As a result, the retaining links 311 are fitted into the attached bodies 319 and the tip end of the arm 305 is fitted onto the space of the attached bodies 319.

As illustrated in FIGS. 29 and 30, since the interval between the pin holes 314 and the retaining grooves 313 and the interval between the axial line of the pin holes and the retaining pin 322 are respectively C, when the retaining links 311 are turned about the retaining pin 322, the axial line of the pin holes 314 always conform to that of the pin holes 320. At the same time, since the interval between the axial lines of the pin holes 314 and 315 and the axial lines of the pin holes 320 and 321 are respectively B, when the axial line of the pin holes 314 conforms to that of the pin holes 320, the axial core of the pin holes 314 always conforms to that of the pin holes 320. When the axial core of the pin holes 315 conforms to that of the pin holes 321, the connecting pin 316 is inserted into the pin holes 314 and 320, and the connecting pin 317 is inserted into the pin holes 315 and 321. The retaining links 311 and the attached bodies 319 are connected by the connecting pins 316 and 317 whereby the bucket 318 is connected to the tip end of the arm 305.

The positioning operation set forth above can be made by the operator sitting on the chassis 301 of the excavator by operating to extend or contract the hydraulic cylinder 304, the hydraulic cylinder 306 and the bucket cylinder 307 without necessitating other operators. The positioning operation can be made by merely swinging the retaining pin 322 about the retaining grooves 313 so that the operation can be completed with simple operation.

Figure 35:
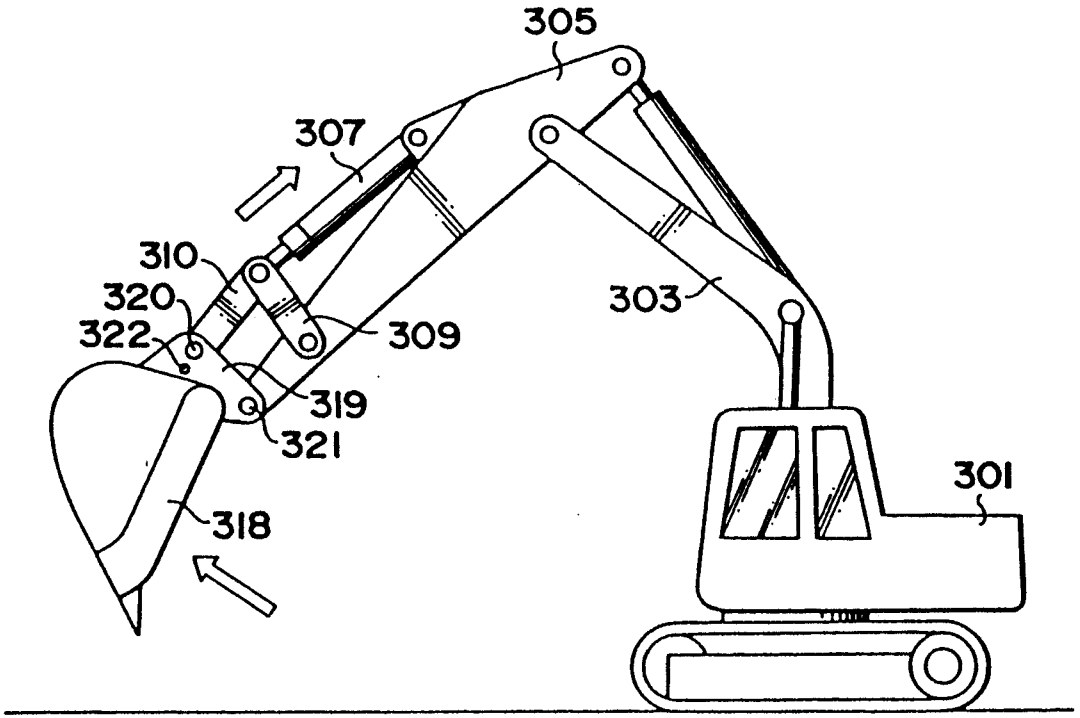
FIG. 35 is a view showing the bucket connected to the arm.

Thereafter, as illustrated in FIG. 35, the bucket cylinder 307 is contracted to thereby operate the hydraulic cylinders 304 and 306 whereby the bucket 318 is lifted.

With a series of procedures set forth above, the bucket 318 can be mounted on the tip end of the arm 305. When the bucket 318 is disconnected from the tip end of the arm 305, the connecting pins 316 and 317 are pulled out from the pin holes 314 and 315 to thereby detach the retaining pin 322 from the retaining grooves 313 in the order of the procedures as illustrated in FIG. 35, FIG. 34 and FIG. 33.

With the arrangement of the fourth embodiment, it is possible to position the four pin holes by the retaining grooves of the retaining links attached to the tip end of the arm and the retaining pin of the accessory with ease although the structure thereof is very simple. Furthermore, the connection between the arm and the accessory is made by two connecting pins, both the arm and the accessory can be connected securely so that there is little likelihood of deformation of the components even if a strong external force is applied to the accessory.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a construction machine including a mobile chassis, a boom swingably mounted on the chassis adjacent one end thereof, an elongate arm pivotally connected to said boom in spaced relationship from said one end and terminating in a tip end, an accessory detachable mechanism connected adjacent to the tip end of the arm and including a cylinder having a remote end pivotally connected to the arm and a front end pivotally attached to said accessory detachable mechanism, and an accessory adapted to be held by the detachable mechanism for swinging movement relative to the arm, said accessory having first and second attached bodies, said attached bodies defining generally parallel and spaced apart planes, said accessory detachable mechanism comprises:

rising links means pivotally connected at an upper end thereof to the front end of the cylinder and at a lower end thereof to said arm at a location adjacent to but spaced rearwardly from the tip end of the arm;

connecting links means pivotally connected at a rear end thereof to the front end of the cylinder;

operating links means pivotally connected at an upper end thereof to said connecting links means in the vicinity of a front end thereof, and pivotally connected at a lower end thereof to said arm closely adjacent the tip end thereof;

alignment means defining retaining grooves on an upper end thereof connected to said operating links means;

said attached bodies defining a first pair of pin holes having a first axial line perpendicular to said attached bodies and a second pair of pin holes defining a second axial line perpendicular to said attached bodies;

a first connecting means for supporting said accessory and defining a third pair of pin holes, defining a third axial line, in the vicinity of the front end of said operating links means and including a first connecting pin removably inserted through said first pair of pin holes and said third pair of pin holes when said first and third axial lines coincide; and a second connecting means for supporting said accessory and defining a fourth pair of pin holes, defining a fourth axial line, in the vicinity of the lower end of said operating links means and including a second connecting pin removably inserted through said second pair of pin holes and said fourth pair of pin holes when said second and fourth axial lines coincide;

retaining means connected to said attached bodies and separate from said first and second connecting means adapted to cooperatively mate with said retaining grooves to align said first pair of pin holes with said third pair of pin holes and said second pair of pin holes with said fourth pair of pin holes, whereby attaching and detaching the detachable accessory is assisted.

2. A machine according to claim 1, wherein said alignment means includes a swinging link pivotally connected at a lower end thereof to said operating links means in the vicinity of the lower end thereof.

3. A machine according to claim 2, further comprising at least one stopper attached between an upper end and the lower end of said swinging link, said stopper being substantially L-shaped and operating to limit the pivotal motion of said swinging link.

4. A machine according to claim 1, wherein said operating links means and said alignment means are integral and share a common pivotal connection to said arm.

5. A machine according to claim 1, wherein said pivotal connection between said operating links means and said connecting links means defines a fifth axis and said third and fifth axes coincide.

6. A machine according to claim 1, wherein said pivotal connection between said operating links means and said connecting links means defines a fifth axis and said third and fifth axes are separate but parallel.

7. A machine according to claim 1, wherein said retaining means includes at least two annular rings attached to said attached bodies.

8. A machine according to claim 1, wherein said retaining means includes a rigid rod connected intermediate said attached bodies.

9. A machine according to claim 8, wherein said alignment means includes at least two retaining pawls attached at the upper end of said alignment means and said retaining pawls being hook-shaped and defining said retaining grooves.

* * * * *